US012623879B2

(12) United States Patent
Sugiyama et al.

(10) Patent No.: US 12,623,879 B2
(45) Date of Patent: May 12, 2026

(54) SHEET PROCESSING APPARATUS AND IMAGE FORMING SYSTEM

(71) Applicant: CANON FINETECH NISCA INC., Saitama (JP)

(72) Inventors: Akira Sugiyama, Yamanashi (JP); Yuta Gemma, Yamanashi (JP); Yoshihiko Minagawa, Yamanashi (JP); Aya Kumagai, Chiba (JP); Kota Hihara, Yamanashi (JP); Takashi Saito, Yamanash (JP); Fumihide Sakamoto, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 207 days.

(21) Appl. No.: 18/539,693

(22) Filed: Dec. 14, 2023

(65) Prior Publication Data

US 2024/0208761 A1 Jun. 27, 2024

(30) Foreign Application Priority Data

| | | |
|---|---|---|
| Dec. 23, 2022 | (JP) | 2022-207678 |
| Dec. 26, 2022 | (JP) | 2022-207938 |
| Feb. 3, 2023 | (JP) | 2023-015730 |
| Nov. 8, 2023 | (JP) | 2023-190678 |

(51) Int. Cl.
*B65H 37/04* (2006.01)
*B65H 31/02* (2006.01)

(52) U.S. Cl.
CPC ..... *B65H 31/02* (2013.01); *B65H 2402/442* (2013.01); *B65H 2551/15* (2013.01); *B65H 2701/1829* (2013.01); *B65H 2801/15* (2013.01)

(58) Field of Classification Search
CPC ..... B65H 2402/442; B65H 2801/27; B65H 2301/51616; B65H 2301/43828; G03G 2215/00852; G03G 2215/00827; B31F 1/07; B31F 5/001; B31F 5/02; B31F 2201/0754; B31F 2201/0779
USPC ..... 270/58.07, 58.08
See application file for complete search history.

(56) References Cited

U.S. PATENT DOCUMENTS

| | | | | |
|---|---|---|---|---|
| 8,235,375 | B2 * | 8/2012 | Shiraishi | G03G 15/6538 270/58.11 |
| 9,346,647 | B2 * | 5/2016 | Obuchi | B42B 4/00 |
| 9,567,184 | B2 * | 2/2017 | Kanemaru | B65H 37/04 |
| 9,586,783 | B2 | 3/2017 | Obuchi et al. | |
| 9,969,144 | B1 * | 5/2018 | Awano | B42B 5/00 |
| 10,048,636 | B2 | 8/2018 | Obuchi et al. | |
| 10,131,107 | B2 * | 11/2018 | Shimizu | B65H 37/04 |
| 10,481,544 | B2 * | 11/2019 | Yoshida | H04N 1/00639 |
| 10,496,023 | B2 | 12/2019 | Obuchi et al. | |
| 10,579,005 | B2 | 3/2020 | Obuchi et al. | |

(Continued)

FOREIGN PATENT DOCUMENTS

JP 2015-016970 A 1/2015

*Primary Examiner* — Leslie A Nicholson, III
(74) *Attorney, Agent, or Firm* — Venable LLP

(57) ABSTRACT

A staple-less binding unit 27 is disposed between a front cover 121 and a sheet stacking table 16, and an insertion port 110 is formed on a first surface 121*a* of the front cover 121 so that manual binding by the staple-less binding unit 27 can be executed from the front side of the apparatus. The staple-less binding unit 27 is provided at a position overlapping a stapling unit 17 positioned at a replacement position in a front-rear direction.

9 Claims, 30 Drawing Sheets

(56) References Cited

U.S. PATENT DOCUMENTS

| | | | | |
|---|---|---|---|---|
| 10,705,471 | B2 | 7/2020 | Obuchi et al. | |
| 11,150,588 | B2 | 10/2021 | Obuchi et al. | |
| 11,520,268 | B2 | 12/2022 | Obuchi et al. | |
| 11,947,301 | B2 * | 4/2024 | Obuchi | B65H 31/36 |
| 2018/0348692 | A1 * | 12/2018 | Yoshida | B65H 37/04 |

* cited by examiner 112
112a
112b
113a
113b
114a
114b
115a
115b
116a
116b
117
127
110a
110c
110f
OFF
ON
L1
X
Z

SHEET PROCESSING APPARATUS AND IMAGE FORMING SYSTEM

BACKGROUND OF THE INVENTION

Field of the Invention

The present invention relates to a sheet binding apparatus for binding sheets, and relates to a sheet binding apparatus including a binding unit for binding a sheet bundle using staples and a binding unit for binding a sheet bundle without using staples.

Description of the Related Art

Conventionally, a sheet binding apparatus that performs a binding process on a plurality of sheets on which an image is formed by an image forming apparatus such as a copying machine or a printer is known.

As such a sheet binding apparatus, a so-called staple binding method of binding a sheet using staples as a binding tool and a so-called staple-less binding method of binding a sheet without using staples as a binding tool are known. In addition, the staple-less binding method includes, for example, a method of binding a sheet by crimping the sheet and entangling fibers of the sheet, and a method of binding a sheet by cutting out a portion of the sheet to form a hole and folding back the cut portion of the sheet to allow the cut portion to pass through the hole. JP 2015-16970 A discloses a sheet binding apparatus including a stapling unit that performs a binding process on a sheet bundle using staples and a staple-less binding unit that performs a binding process on a sheet bundle without using staples, in which the staple-less binding unit is disposed on a rear side of the apparatus.

In recent years, there is a demand for manual binding by a staple-less binding unit. In order to meet the demand, an object of the present invention is to provide a sheet binding apparatus capable of performing manual binding by a staple-less binding unit on the front side of the apparatus.

SUMMARY OF THE INVENTION

The present invention provides a sheet processing apparatus that performs a binding process on a sheet, the sheet processing apparatus comprising: a stacking portion configured to stack sheet; a first binding unit including a cartridge loaded with staples is detachably attached, the first binding unit being configured to perform a binding process on a plurality of sheets stacked on the stacking portion, the first binding unit being movable between a binding position at which the binding process is performed on the sheets and a replacement position at which the cartridge is replaced, the replacement position being positioned on a front side with respect to the binding position in a front-rear direction of the sheet processing apparatus; a cover that constitutes a portion of an exterior of the sheet processing apparatus on a front side with respect to the stacking portion and the first binding unit in the front-rear direction, the cover including an insertion port into which a sheet bundle can be inserted from an outside of the sheet processing apparatus; and a second binding unit that performs a binding process on the sheet bundle inserted from the insertion port without using staples, wherein the second binding unit is provided at a position overlapping the first binding unit positioned at the replacement position in the front-rear direction.

Further features of the present invention will become apparent from the following description of exemplary embodiments with reference to the attached drawings.

DESCRIPTION OF THE EMBODIMENTS

First Embodiment

Figure 1:
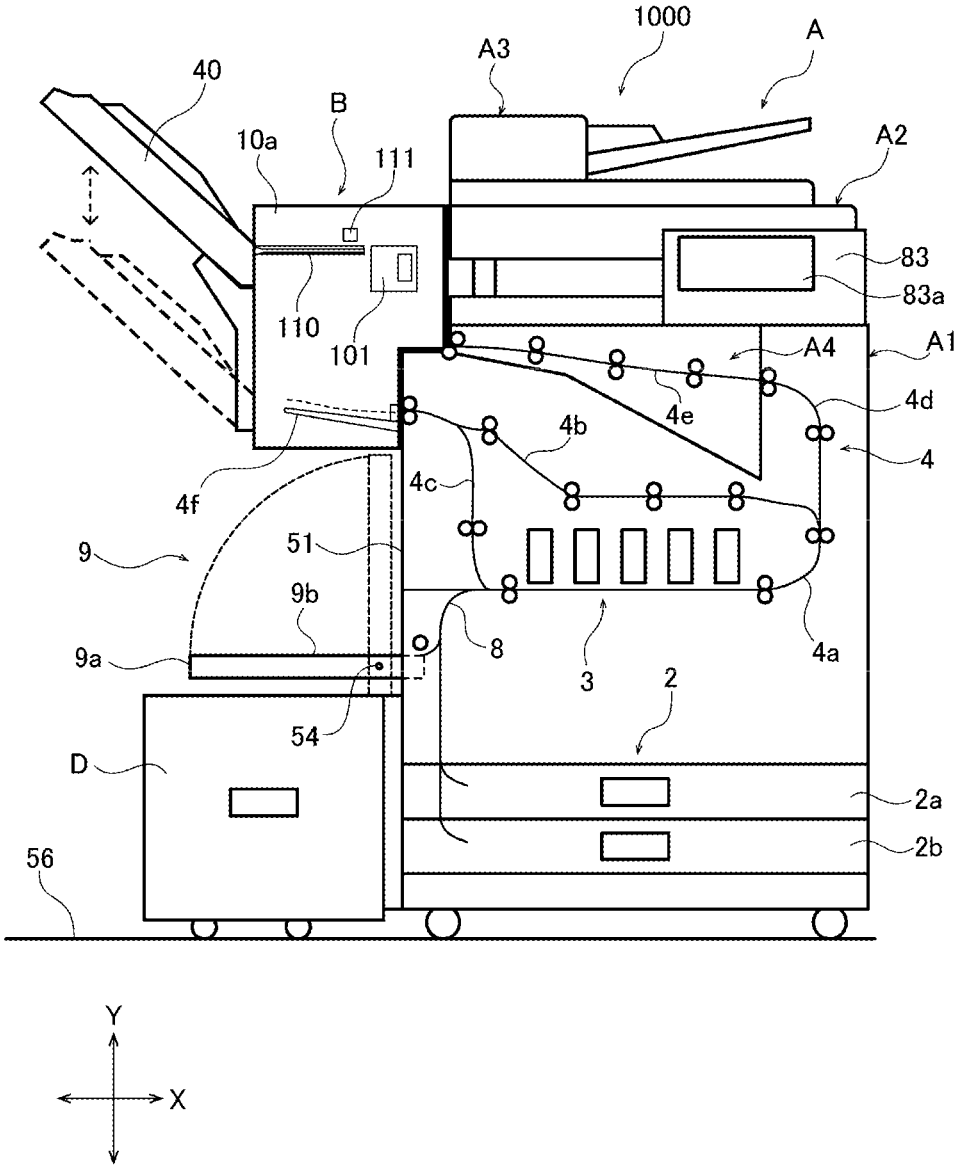
FIG. 1 is an explanatory diagram of an overall configuration of an image forming system according to the present invention.

Hereinafter, preferred embodiments of the present invention will be described in detail with reference to the accompanying drawings. In the accompanying drawings, the same or similar components are denoted by the same reference numerals.

Image Forming System

FIG. 1 is an explanatory diagram illustrating an entire configuration of an image forming system 1000 as viewed from the front side. In the present specification, unless otherwise specified, the front surface is a side surface facing a user when the user operates the image forming system 1000 as illustrated in FIG. 1. That is, the side surface on which an operation portion 83 operated by the user is disposed is the front side. Further, in the present specification, the right and left refer to the left side and the right side (direction of arrow X in FIG. 1) when the image forming system 1000 is viewed from the front, and the up and down refer to the upper side and the lower side (direction of arrow Y in FIG. 1: vertical direction) when the image forming system 1000 is viewed from the front.

The image forming system 1000 includes an image forming apparatus A and a sheet processing apparatus B as a post-processing apparatus that performs processing on a sheet on which an image has been formed by the image forming apparatus. The image forming system 1000 of the present embodiment further includes an external feeding apparatus D that supplies a sheet to the image forming apparatus A.

Image Forming Apparatus

The image forming apparatus A includes an image forming portion A1, an image reading portion A2, and an original feeding portion A3. The image forming portion A1 is configured to form an image on a sheet by an inkjet printing mechanism, and includes a main body feeding portion 2, an image forming unit 3, a conveying portion 4, and a main body controller (described later).

The image reading portion A2 having an image reading unit therein and the original feeding portion A3 having an original feeding portion that conveys an original to the image reading portion A2 are provided above the image forming portion A1. On the front side with respect to the image reading portion A2, the operation portion 83 operable by a user to perform setting such as selection of a feeding destination is provided. The operation portion 83 is provided with a touch panel 83*a*, and a user can instruct processing contents to the image forming apparatus A and the sheet processing apparatus B by performing a touch operation on the touch panel 83*a*. Note that, although the operation portion 83 including only the touch panel 83*a* is illustrated in the present embodiment, the operation portion 83 may include various hardware keys.

The image forming apparatus A of the present embodiment is a so-called in-body discharge type, and the image forming unit 3, the conveying portion 4, and the image reading portion A2 are arranged in a substantially U-shape. Therefore, an in-body space open to the left side (sheet processing apparatus B side) and the front side in the drawing is disposed between the image forming unit 3 and the image reading portion A2 in the vertical direction of the image forming apparatus A. In the present embodiment, a first relay conveying unit A4 is disposed in the in-body space. The first relay conveying unit A4 is a conveying portion for conveying a sheet discharged from the image forming apparatus A to the sheet processing apparatus B, and is a unit attached to the image forming apparatus A when forming the image forming system 10000 in which the image forming apparatus A and the sheet processing apparatus B are connected. The in-body space of the image forming apparatus A is a so-called in-body discharge space in which a sheet on which an image is formed by the image forming unit 3 is stacked in a state where the first relay conveying unit A4 is not mounted.

In the main body feeding portion 2, a plurality of stages (two stages in the present embodiment) of sheet cassettes 2*a* and 2*b* are detachably provided. Sheets having different sizes can be accommodated in the sheet cassettes 2*a* and 2*b*. The main body feeding portion 2 feeds a sheet having a size instructed by a user via the operation portion 83 or an external apparatus from a corresponding sheet cassette, and feeds the sheet to the image forming unit 3 via a sheet feeding path 8.

The image forming portion A1 is provided with a manual feeding portion 9 in addition to the main body feeding portion 2. The manual feeding portion 9 includes a manual feed tray 9*a* provided on the left side surface of the image forming apparatus A. The manual feed tray 9*a* is rotatable between an open position (solid line in FIG. 1) and a closed position (broken line in FIG. 1) about a rotary shaft 54 near a lower end thereof when viewed from the front side. The manual feed tray 9*a* has an upper surface that is substantially horizontally open in a state where the manual feed tray 9*a* is positioned at the open position, and has a stacking surface 9*b* for stacking sheets to be supplied to the image forming unit A1. A manual feed port (not illustrated) provided on the left side surface of the image forming apparatus A is open by the rotation of the manual feed tray 9*a*. When the manual feed tray 9*a* is not in use, as indicated by a broken line in FIG. 1, the manual feed tray 9*a* can be returned to the closed position along the left side surface of the image forming apparatus A to close the manual feed port.

The sheet stacked on the stacking surface 9*b* of the manual feed tray 9*a* positioned at the open position (feeding position) is fed into the image forming portion A1 by a feeding roller (not illustrated) provided near the manual feeding port of the image forming apparatus A, joins the sheet feeding path 8, and is fed to the image forming portion 3. A feeding mechanism can be integrally provided on the manual feed tray 9*a* so that a larger number of sheets can be stacked in an aligned state.

The feeding apparatus D is detachably connected to the left side surface of the image forming apparatus A similarly to the manual feeding portion 9. The feeding apparatus D can accommodate a larger number of sheets (for example, several hundred sheets to several thousand sheets) than the sheet cassettes 2*a* and 2*b* of the main body feeding portion 2. The sheet fed from the feeding apparatus D joins the sheet feeding path 8 and is fed to the image forming unit 3 similarly to the manual feeding portion 9.

Further, the sheet processing apparatus B is provided with a reverse tray 4*f* in order to reverse a sheet on which an image is formed on one side by the image forming portion 3 and form an image also on the back side. The reverse tray 4*f* is provided on the left side surface of the image forming apparatus A similarly to the manual feeding portion 9, inside the sheet processing apparatus B, and is disposed so as to secure a constant sheet support space. The reverse tray 4*f* may be disposed not inside the sheet processing apparatus B but between the sheet processing apparatus B and the manual feeding portion 9 in the vertical direction.

The image forming portion 3 includes units of respective colors such as yellow, magenta, cyan, and black, and can form images on the conveyed sheet. In the present embodiment, the image forming portion 3 indicates an inkjet head that is unitized for each color. Note that the image forming unit 3 only needs to be configured to form an image on a sheet fed from the main body feeding portion 2, the manual feeding portion 9, or the feeding apparatus D, and various image forming mechanisms can be adopted. In the present embodiment, the inkjet-type image forming portion has been described, but various other image forming mechanisms such as an electrophotographic system, an offset printing system, and a silk printing system can also be adopted.

The image forming apparatus A includes the sheet feeding path 8, a first conveying path 4*a*, a second conveying path 4*b*, a third conveying path 4*c*, and a fourth conveying path 4*d* as conveying paths included in the conveying portion 4. The sheet feeding path 8 is a conveying path along which a sheet fed from the main body feeding portion 2, the manual feeding portion 9, and the feeding apparatus D is conveyed to an image forming position by the image forming portion 3. The first conveying path 4*a* is a conveying path on which a sheet is conveyed while an image is being formed by the image forming portion 3. The second conveying path 4*b* is a conveying path through which a sheet on one side of which an image is formed by the image forming portion 3 is conveyed to the reverse tray 4*f*. The third conveying path 4*c* is a conveying path in which a sheet that has been switch-back conveyed from the reverse tray 4*f* and whose front and back sides have been reversed is conveyed again to the image forming unit 3. The fourth conveying path 4*d* is a conveying path in which a sheet on which an image is formed on one side or both sides is conveyed to the relay conveying unit A4. Note that, although the description is omitted, a plurality of pairs of conveying rollers is provided in each conveying path as illustrated, and the sheet is conveyed by each pair of conveying rollers.

The fourth conveying path 4*d* is connected to the relay conveying path 4*e* so that the sheet can be delivered to the relay conveying path 4*e* provided in the relay conveying unit A4. The relay conveying path 4*e* is a conveying path in which a plurality of pairs of conveying rollers is disposed along the sheet conveying direction and conveys the sheet toward the feeding port 12 (FIG. 2) of the sheet processing apparatus B.

The image reading portion A2 can read an original image by irradiating an original placed on a platen glass (not illustrated) with light from a light source and inputting the reflected light to a CCD. Further, the image reading portion A2 can read an image of an original conveyed by the automatic original feeding portion by stopping at a flow reading position (not illustrated). The read original image is converted into an electrical signal and transmitted to the image forming unit 3 as image data. The platen glass (not illustrated) is exposed by rotating the original feeding portion upward.

Sheet Processing Apparatus

As illustrated in FIG. 1, the sheet processing apparatus B is supported at an upper left corner of the image forming apparatus A. The sheet processing apparatus B is fixed to and supported by the image forming apparatus A so as to be positioned on the left side with respect to the image reading portion A2 and the original feeding portion A3. The sheet processing apparatus B has an automatic binding function and a manual binding function. In the automatic binding function, the stapling unit 17 performs a binding process on sheets conveyed from the image forming apparatus A, and the sheets subjected to the binding process are discharged to a stack tray 40. In the manual binding function, the stapleless binding unit 27 performs a binding process on the sheet inserted into the manual insertion port from the outside of the apparatus by the user.

The configuration will be described below with reference to FIGS. 2, 3, and 15. In the present embodiment, the stapling unit 17 is an example of a first binding unit, and the stapleless binding unit 27 is an example of a second binding unit.

Sheet Conveying Path

The sheet processing apparatus B includes a receive port 12 for receiving the sheet discharged from the relay discharge port of the relay conveying unit A4 and a discharge port 13 for discharging the sheet to the stack tray 40. The sheet conveying path 11 is configured as a discharge path for transferring the sheet fed from the relay discharge port toward the stack tray 40 to be described later, and a sheet end detection sensor Se1 for detecting a front end and a rear end of the sheet, conveying rollers 14*a* and 14*b* for conveying the sheet, an upper conveying path guide 28 and a lower conveying path guide 29 for guiding the sheet conveyed by the conveying rollers 14*a* and 14*b* are appropriately arranged in the path. The upper conveying path guide 28 and the lower conveying path guide 29 are arranged to face each other to form a sheet conveying path. Further, each of the conveying rollers 14*a* and 14*b* is connected to a drive motor (not illustrated), and rotates by being driven. The illustrated sheet conveying path 11 is configured as a substantially straight path in a substantially horizontal direction. The processing portion 15 is provided on the upstream side and the stack tray 40 is provided on the downstream side with respect to the discharge port 13 of the sheet conveying path 11.

Process Tray

Figure 2:
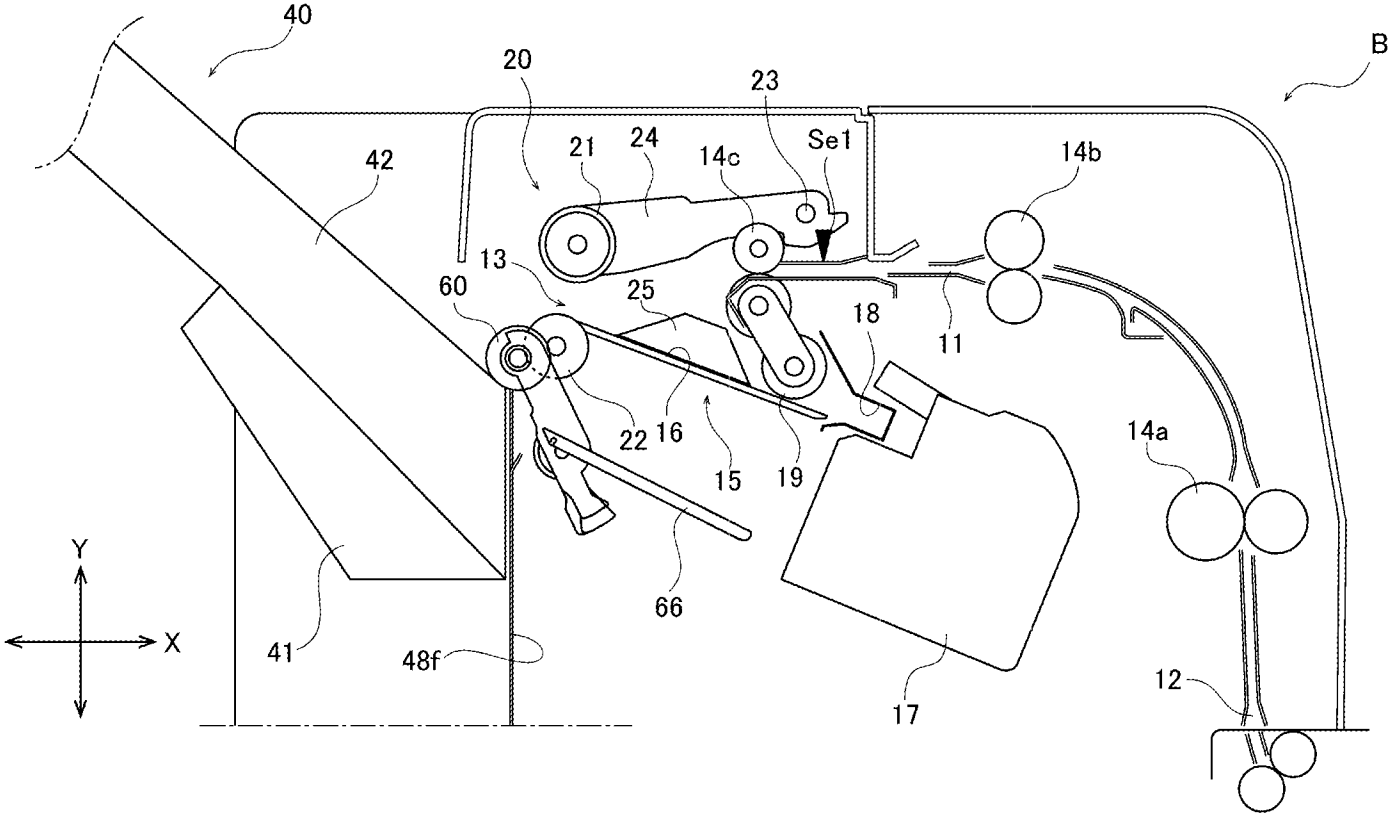
FIG. 2 is an explanatory diagram of a configuration of a sheet processing apparatus in the image forming system of FIG. 1.

As illustrated in FIG. 2, the processing portion 15 includes a sheet stacking table 16, alignment members 25*f* and 25*r*, a stapling unit 17, and a rear end regulating stopper 18. The sheet stacking table 16 is disposed so as to form a step with respect to the stacking surface of the stack tray 40, and stacks and supports sheets. The alignment members 25*f* and 25*r* are a pair of alignment members that are movable in the width direction (direction of arrow Z in FIG. 3, a front-rear direction of the sheet processing apparatus B) of the sheets stacked on the sheet stacking table 16 and align the sheets stacked on the sheet stacking table 16 in the width direction to correct the misalignment of the sheet bundle. The stapling unit 17 performs a binding process on a sheet bundle including sheets stacked on the sheet stacking table 16 using staples. The rear end regulating stopper 18 regulates movement of the sheet end on the downstream side in the sheet conveying direction of a friction rotating member 19 described later. In the processing portion 15, the sheets are supported (bridge-supported) in a state of straddling the stack tray 40 and the sheet stacking table 16. As described above, the stack tray 40 and the processing portion 15 are arranged on substantially the same plane, the front-end-side portion of the sheet is supported by one tray, and the rear-end-side portion is supported by the other tray, so that the apparatus can be downsized as compared with the configuration in which the sheet is supported by one tray.

The sheet stacking table 16 is provided with the rear end regulating stopper 18 that regulates abutment of the rear end of the sheet, and the alignment member 25 that aligns the sheets by aligning the widths of sheets in a direction orthogonal to the sheet discharge direction. Here, various mechanisms are known as an alignment mechanism that aligns the width direction of the sheet, but the alignment member 25 of the present embodiment can align the widths of the sheets to align the sheets by moving plate-shaped members (the front aligning plate 25*f* and the rear aligning plate 25*r*) protruding from the stacking surface of the sheet stacking table 16 along the guide groove 26 extending in the sheet width direction. The sheet stacked onto the sheet stacking table 16 is once positioned at the aligned position by the alignment member 25. The illustrated apparatus illustrates a configuration for performing matching based on the center.

In the processing portion 15, the stapling unit 17 for binding the sheet bundle accumulated on the sheet stacking table 16 is disposed as a post-processing unit. The stapling unit 17 is an apparatus that bends a linear staple stacked in the staple cartridge 170 in a U-shape, inserts the staple from the upper surface to the lower surface of the sheet bundle, and bends a staple tip (see JP 2015-124069 A). The staple cartridge 170 is configured to be detachably attached to the stapling unit 17. The user pulls out the empty staple cartridge 170 from the front side of the sheet processing apparatus B with respect to the stapling unit 17 in the direction of arrow EX (direction from the rear side to the front side) in FIG. 4, and inserts the staple cartridge 170 in which the staple is newly stacked into the stapling unit 17 in the direction of arrow EX (direction from the front side to the rear side) to perform staple replenishment (staple replacement).

Figure 3:
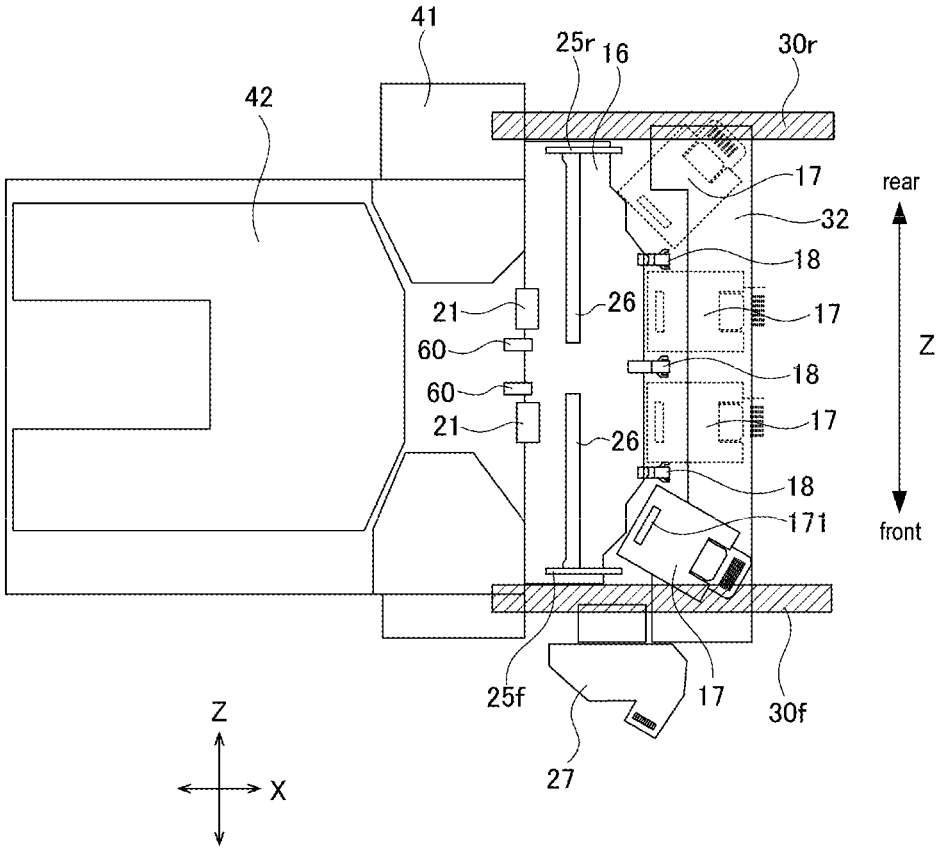
FIG. 3 is a top view of a stack tray and a process tray.
Figure 4:
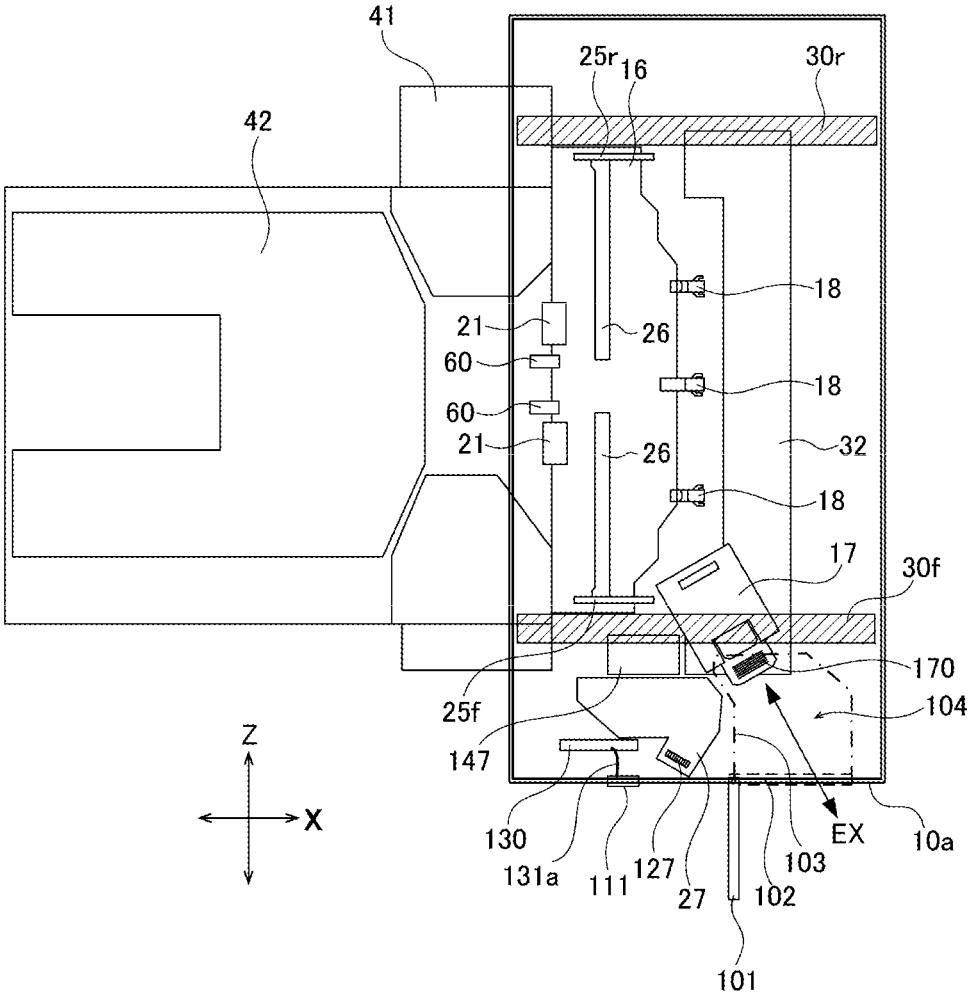
FIG. 4 is a top view of the stack tray and the process tray, illustrating a state in which a stapling unit is positioned at a cartridge replacement position.

As illustrated in FIGS. 3 and 4, the stapling unit 17 of the present embodiment is configured to be movable in a front-rear direction which is the direction of arrow Z in the drawings. The stapling unit 17 moves in the front-rear direction by moving along a guide groove (not illustrated) of the support member 32. The stapling unit 17 can perform a plurality of types of binding processes such as front corner binding, rear corner binding, and two-location parallel binding on the sheet bundle AS (see FIG. 9) formed on the sheet stacking table 16. In the front corner binding, the stapling unit 17 performs the binding process on the front side corner of the sheet bundle at the binding position indicated by the solid line in FIG. 3. In the rear corner binding, the stapling unit 17 performs the binding process on the rear side corner of the sheet bundle at the binding position indicated by the broken line on the rear side in FIG. 3. In the two-position parallel binding, the binding process is performed at two locations on the side along the sheet end on which the rear end regulating stopper 18 abuts (the binding position of the stapling unit 17 indicated by a broken line between the position of the solid line on the front side and the position of the broken line on the rear side in FIG. 3).

The stapling unit 17 is also configured to be movable to the cartridge replacement position illustrated in FIG. 4. In the present embodiment, the cartridge replacement position is set closer to the front side than the position of the front corner binding, but staple replenishment can be performed at the position of the front corner binding. In this case, the angle of the stapling unit 17 may be changed to facilitate the removal of the staple cartridge 170 from the front side of the apparatus.

A reverse roller mechanism 20 is disposed in the discharge port 13 of the sheet conveying path 11. The reverse roller mechanism 20 reverses the conveying direction when the sheet rear end (the upstream end in the sheet conveying direction of the conveying roller 14*b*) passes through the sheet end detection sensor Se1, is conveyed by a predetermined amount, and passes through the nip of the conveying roller 14*c*. As a result, the sheet is conveyed in a direction opposite to the discharge direction of the conveying roller 14*c*, and is guided to the rear end regulating stopper 18 along the sheet stacking table 16 of the processing portion 15.

The processing portion 15 includes a friction rotating member 19 that guides the sheet to the rear end regulating stopper 18 in cooperation with a reverse roller mechanism 20 disposed in the discharge port 13. The friction rotating member 19 is disposed at a position abutting on the sheet stacked on the sheet stacking table 16. The friction rotating member 19 is configured as a scraping roller (which may be a belt), and is transmitted by a drive belt (not illustrated) so as to rotate integrally with the conveying roller 14*c*. The friction rotating member 19 abuts on the sheet stacked on the sheet stacking table 16 by its own weight. The sheet conveyed in the direction closer to the rear end regulating stopper 18 by the reverse roller mechanism 20 is conveyed to the rear end regulating stopper 18 by the rotation of the friction rotating member 19 which is a scraping roller and abuts on the rear end regulating stopper 18.

Reverse Roller Mechanism

The reverse roller mechanism 20 includes an upper roller 21 that abuts on the upper surface of the sheet conveyed by the conveying roller 14*c* and a lower roller 22 that abuts on the lower surface of the sheet conveyed by the conveying roller 14*c*. The reverse roller mechanism 20 conveys the sheet in a sheet discharge direction that is the same direction as the conveying direction of the conveying roller 14*c*, and then switches the conveying direction to the reverse direction to stack the sheet into the processing portion 15. The upper roller 21 is swingably supported with respect to an apparatus frame F, and is configured to be able to ascend and descend between an operation position where the upper roller comes into pressure contact with the lower roller and a standby position where the upper roller is separated from the lower roller 22. Then, the rotation of the roller drive motor (forward/reverse rotation motor) is transmitted, and the upper roller 21 is rotatable in a first rotation direction (clockwise direction in the drawing) when the sheet is discharged toward the stack tray 40 and a second rotation direction (counterclockwise direction in the drawing) which is a direction opposite to the first rotation direction.

A pair of left and right roller brackets (swing arms) 24 is supported by the apparatus frame F, which is a support frame body of the sheet processing apparatus B, so as to be swingable about the rotation support shaft 23. A roller rotating shaft is rotatably supported by the pair of roller brackets 24 via bearings. The upper roller 21 is fitted to a rotation shaft supported by the pair of roller brackets 24, and the upper roller 21 is rotatable with respect to the pair of roller brackets 24 by the rotation shaft. The rotation support shaft 23 is rotatably or fixedly supported by the apparatus frame F. The roller bracket 24 is directly fitted to the swing fulcrum or fitted to the rotation support shaft 23 via collar parts. As a result, the upper roller 21 supported by the pair of roller brackets 24 is supported to be swingable in an arbitrary angular direction around the rotation support shaft 23. A collar part is loosely fitted to the rotation support shaft 23, and a driving pulley (not illustrated) that transmits rotation to the rotation shaft of the upper roller 21 is connected to the collar part. A roller driving motor is connected to the driving pulley.

The reverse roller mechanism 20 has a "first discharge mode" and a "second discharge mode" as a sheet discharge mode, and selectively discharges the sheet to the stack tray 40 and the processing portion 15 based on each mode. In the first discharge mode, sheets are nipped one by one by the upper roller 21 and the lower roller 22 and directly discharged to the stack tray 40 on the downstream side. Note that the first discharge mode includes shift discharge in which a sheet is discharged on the stack tray 40 so as to be stacked on the stack tray in a state where the sheet is shifted in the width direction for each portion, and straight discharge in which the sheet is discharged without sorting. In the second discharge mode, the sheets fed from the discharge port are stacked on the sheet stacking table 16 and the lower roller 22. In the second discharge mode, when a plurality of sheets are accumulated on the sheet stacking table 16, the sheets are further conveyed onto the uppermost sheet in the already accumulated sheet bundle. In this case, the sheet further conveyed onto the uppermost sheet of the sheet bundle on the sheet stacking table 16 is once conveyed in the discharge direction (direction from the sheet stacking table 16 toward the stack tray 40) by the upper roller 21, and then conveyed in the direction opposite to the discharge direction (direction from the sheet stacking table 16 toward the rear end regulating stopper 18). That is, when sheets are stacked on the sheet stacking table 16, the sheets are switchback conveyed. Thereafter, the sheet bundle accumulated on the sheet stacking table 16 and subjected to various types of processing such as a binding process is discharged from the sheet stacking table 16 to the stack tray 40 by the reverse roller mechanism 20.

Note that, although the configuration in which the sheet bundle is conveyed to the stack tray 40 by the reverse roller mechanism 20 after the sheet bundle accumulated in the processing portion 15 is bound has been described, it is also possible to arrange a conveyor mechanism that unstacks the sheet bundle from the processing portion 15 together with the reverse roller mechanism 20.

As illustrated in FIG. 4, the rear end regulating stopper 18 is formed of a plate-like member which regulates the rear end of the sheet by abutting, and is disposed at one location or a plurality of locations at a distance in the sheet width direction (in FIG. 4, the rear end regulating stoppers 18 are provided at a plurality of locations at intervals in the sheet width direction). Since the stopper is disposed on the sheet rear end side of the sheet stacking table 16 together with the stapling unit 17, when the stapling unit is configured to be movable in the sheet width direction, the rear end regulating stopper 18 is also configured to move in the sheet width direction in conjunction with the stapling unit 17. Further, when the stapling unit 17 is fixedly disposed without being moved in the sheet width direction, the rear end regulating stopper 18 can be integrally formed with the stapling unit.

Stack Tray

Next, the stack tray will be described. As illustrated in FIG. 2, the stack tray 40 is disposed on the downstream side with respect to the discharge port 13. The processing portion 15 described above is disposed on the upstream side with respect to the discharge port 13 in the sheet conveying direction of the conveying roller 14*c*. That is, the stack tray 40 is disposed on the downstream side with respect to the processing portion 15 in the sheet conveying direction of the conveying roller 14*c*.

The stack tray 40 includes a tray base 41 and a tray 42. The tray base 41 is supported so as to ascend and descend with a predetermined stroke with respect to the frame F of the sheet processing apparatus B. The tray 42 is formed in a tray shape having a tray surface on which sheets are stacked. The tray 42 is supported by the tray base 41. Note that the tray 42 is provided with a shift mechanism described later so as to shift by a predetermined amount in the sheet width direction with respect to the tray base 41.

Tray Lifting Mechanism

Figure 5:
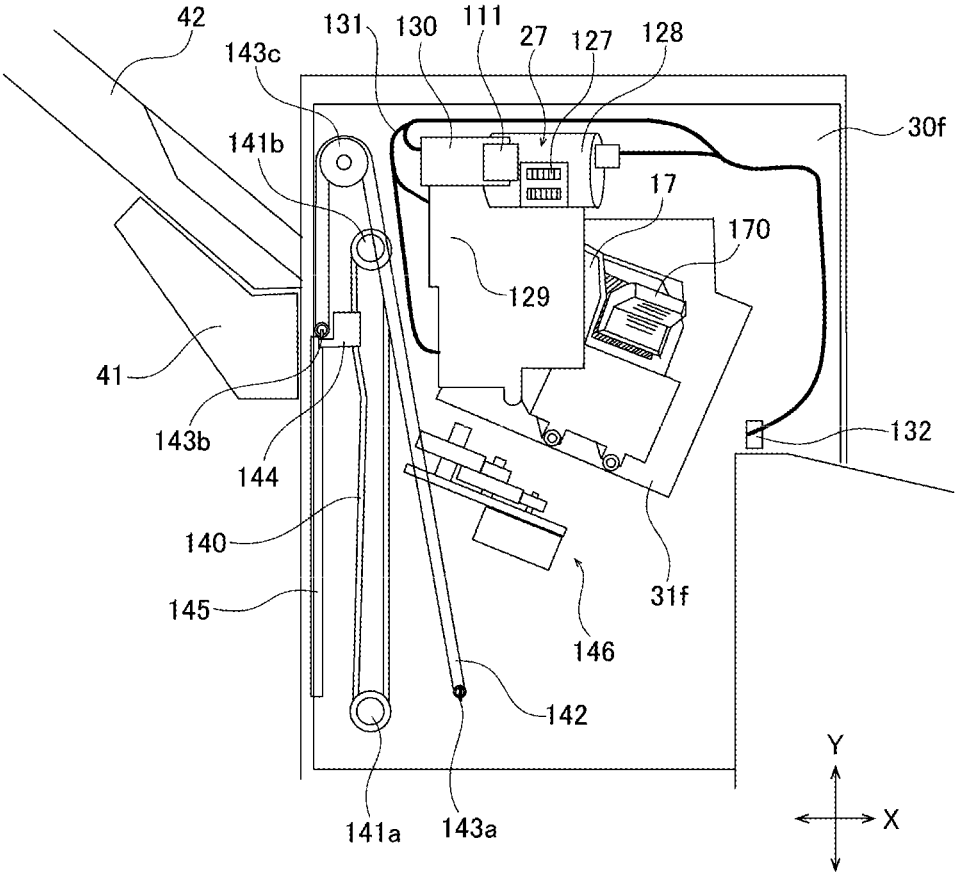
FIG. 5 is a front view of the sheet processing apparatus.

FIG. 5 illustrates a lifting mechanism of the stack tray 40. On the apparatus frame F of the sheet processing apparatus B, a guide rail 145 is extended in a sheet stacking direction (vertical direction). A slide roller (not illustrated) fixed to a joint plate 144 of the tray base 41 is fitted to the guide rail 145. The guide rail 145 is formed of a rod-like guide, channel steel, H-shaped steel, or the like, and the tray base 41 is slidably fitted thereto.

The tray base 41 is formed in a frame structure having a strength to support a stack of the tray 42 and a stack of the sheets stacked thereon, and is cantilevered by a guide rail similarly firmly formed. In the apparatus frame F of the sheet processing apparatus B, a wind-up pulley 141*a* is fixed to the lower end of the guide rail 145, and a suspension pulley 141*b* is fixed to the upper end of the guide rail 145. A towing member 140 such as a wire or a toothed belt is suspended between the wind-up pulley 141*a* and the suspension pulley 141*b*. A wind-up motor (not illustrated) fixed to a front sheet metal 30*f* (FIG. 3) of the apparatus frame F is connected to the wind-up pulley 141*a* via a deceleration mechanism.

At the same time, a coil spring 142 for weight reduction is bridged between the tray base 41 and the apparatus frame of the sheet processing apparatus. That is, one end 143*a* of the coil spring 142 is fixed to the apparatus frame F, and the other end 143*b* is fixed to the tray base 41 via the traction pulley 143*c*. A tensile force is applied to the spring 142. Therefore, the weight of the stacking tray and the sheets stacked on the tray 42 is reduced according to the elastic force of the coil spring 142, and the stack torque of the winding motor is reduced. In addition, a weight reduction mechanism that suspends the weight from the suspension pulley may be adopted instead of the coil spring.

Stacking Tray

The tray 42 includes a stacking surface 42*a* on which the sheets fed from the upper discharge port 13 are stacked. The stacking surface 42*a* may be parallel to the horizontal plane, but is inclined at a predetermined angle with respect to the horizontal plane in the present embodiment. This is because the sheet discharged onto the stacking surface 42*a* moves to the rear end side in the discharge direction by its own weight to maintain alignment in the tray 42. When the inclination angle of the stacking surface 42*a* is 30 degrees or less with respect to the horizontal line, the sheet does not return by its own weight, and it becomes difficult to correct the posture of the sheet. In the present embodiment, the tray 42 is set to about 45 degrees. An object is to enable a large number of sheets to be stacked at a higher speed by setting a large inclination angle in order to receive the sheet discharged from the discharge port 13 at a high speed and quickly regulate the sheet on the rear end side.

The tray 42 is supported by the tray base 41 and moves up and down along the guide rail 145. The apparatus frame F is provided with a fence plate having a rear end regulating surface 48*f* that regulates the rear end of the sheet. The fence plate may have a wall surface structure fixed to the apparatus frame. However, since the illustrated structure is a structure in which the tray 42 is shifted by a predetermined amount in the sheet width direction (front-rear direction), the fence plate is also shifted simultaneously with the stacking tray. The shift mechanism has, for example, a configuration described in JP 2014-47026 A.

Each mechanism of the sheet processing apparatus B is supported by the apparatus frame F including the front sheet metal 30*f* and the rear sheet metal 30*r* at a position inside the exterior cover of the sheet processing apparatus B. In the present embodiment, the front sheet metal 30*f* and the rear sheet metal 30*r* among the elements constituting the apparatus frame F are illustrated, but the apparatus frame F further includes other metal members such as a post and a bottom plate (not illustrated). In addition, the motor and the substrate for driving each mechanism are supported on the side surface on the rear side of the rear sheet metal 30*r* and the side surface on the front side of the front sheet metal 30*f* in the front-rear direction of the sheet processing apparatus B.

Manual Binding Unit (Staple-Less Binding Unit)

Next, the manual binding function will be described with reference to FIG. 6. The sheet processing apparatus B has a manual binding function of performing a binding process on a sheet inserted into the manual insertion port from the outside of the apparatus by the user using the staple-less binding unit 27. In the present embodiment, the stapling unit 17 used when the automatic binding function is executed and the staple-less binding unit 27 used when the manual binding function is executed are accommodated in the sheet processing apparatus B. However, the housings may be separated from each other. The staple-less binding unit 27 is provided between the front cover 10*a* and the front sheet metal 30*f* of the sheet processing apparatus B. The staple-less binding unit 27 is for performing the staple-less binding process on the corner of the sheet bundle MS inserted into an insertion port 110 from the outside (front side) of the sheet processing apparatus B.

The staple-less binding unit 27 (press binding unit) includes a pressing portion (clinching portion) 127 that performs a binding process by nipping sheet surfaces of a sheet bundle from both sides, a motor 128 that moves the pressing portion 127 between a binding position at which the sheet bundle is pressurized and bound and a separation position at which the unit is separated from the sheet bundle, a drive transmission portion 129 that transmits power of the motor 128 to the pressing portion 127, a sensor (not illustrated), and the like.

A detection mechanism (to be described in detail later) that detects insertion of the sheet bundle MS into the insertion port 110 is provided inside the front cover 10*a* (on the rear side). When the detection mechanism detects the sheet bundle MS and the button 111 is pressed by the user, the staple-less binding unit 27 performs a staple-less binding process on the sheet bundle MS. As illustrated in FIG. 6, the button 111 is provided on the front-side side surface of the front cover 10*a* and above the insertion port 110 in the vertical direction. Further, the button 111 is disposed on the right regulating portion 110*a* side with respect to the center of the insertion port 110 in the direction of arrow X and on the left side of the right regulating portion 110*a*. In the present embodiment, the button 111 is an example of an operation button operated by the user when the manual stapling function is executed.

By arranging the button 111 at this position, the user can easily push the button 111 with the thumb of the right hand while supporting the sheet in a state where the sheet bundle MS is inserted into the insertion port 110 and the right end of the sheet bundle MS abuts on the right regulating portion 110*a*.

As illustrated in FIG. 5, the button 111 is connected to the substrate 130 disposed inside the front cover 10*a* by a harness 131*a*. The substrate 130 is disposed between the front cover 10*a* and the staple-less binding unit 27.

FIG. 4 is a schematic cross-sectional view for explaining the arrangement of each unit in a state where the sheet processing apparatus B is viewed from above. FIG. 5 is a view of the front sheet metal 30*f* viewed from the front in a state where the exterior cover on the front side of the sheet processing apparatus B is removed. The tray lifting mechanism, the motor 147 (FIG. 4) for lifting and lowering the tray, the staple-less binding unit 27, and the drive mechanism 146 for moving the stapling unit 17 in the front-rear direction are fixed to the front side surface of the front sheet metal 30*f*. A front opening 31*f* is formed in the front sheet metal 30*f*. In the stapling unit 17, a portion (at least a portion operated by the user) of the staple cartridge 170 protrudes toward the front side with respect to the front sheet metal 30*f* via the front opening 31*f* at the cartridge replacement position when the user replaces the staple cartridge 170. That is, the stapling unit 17 including the staple cartridge 170 protrudes toward the front side with respect to the front sheet metal 30*f* via the front opening 31*f*.

Therefore, as illustrated in FIG. 4, at the cartridge replacement position where the stapling unit 17 is positioned closest to the front side, the stapling unit 17 including the staple cartridge 170 protrudes toward the front side from the front sheet metal 30*f* via the front opening 31*f*. In the present embodiment, in this configuration, the staple-less binding unit 27 is disposed at a position overlapping a portion (specifically, the staple cartridge 170) of the stapling unit 17 positioned at the cartridge replacement position in the front-rear direction of the sheet processing apparatus B. As a result, the size in the front-rear direction of the sheet processing apparatus B can be reduced as compared with the configuration in which the staple-less binding unit 27 is arranged on the front side with respect to the stapling unit 17 in the state of being positioned on the most front side. Therefore, it is possible to provide a sheet processing apparatus capable of performing manual binding by the staple-less binding unit on the front side with respect to the sheet processing apparatus B and capable of replacing the staples of the stapling unit 17 on the front side. In such a sheet processing apparatus B, the size of the apparatus in the front-rear direction can be reduced.

The staple-less binding unit 27 is fixed to the front sheet metal 30*f* at a position not overlapping a portion of the staple cartridge 170 operated by the user so as not to deteriorate operability when the user replaces the staple cartridge 170. The harness 131 connected to the substrate 130 and other harnesses (not illustrated) are supported by and fixed to the front sheet metal 30*f* while avoiding the front opening 31*f*. The harness supported by and fixed to the front sheet metal 30*f* is connected to a main board (not illustrated) disposed on the further rear side of the rear sheet metal 30*r* through the opening 132. Note that the harness 131 connected to the staple-less binding unit 27 and the substrate 130 may be connected to a relay substrate (not illustrated), and may be connected from the relay substrate to the main substrate.

In the present embodiment, the staple-less binding unit 27 is disposed at a position not overlapping the spring 142 and the drive mechanism 146 in the front-rear direction. Therefore, the size of the sheet processing apparatus B can be reduced in the front-rear direction as compared with a configuration in which the staple-less binding unit 27 is disposed at a position overlapping the spring 142 and the drive mechanism 146 in the front-rear direction.

Figure 6:
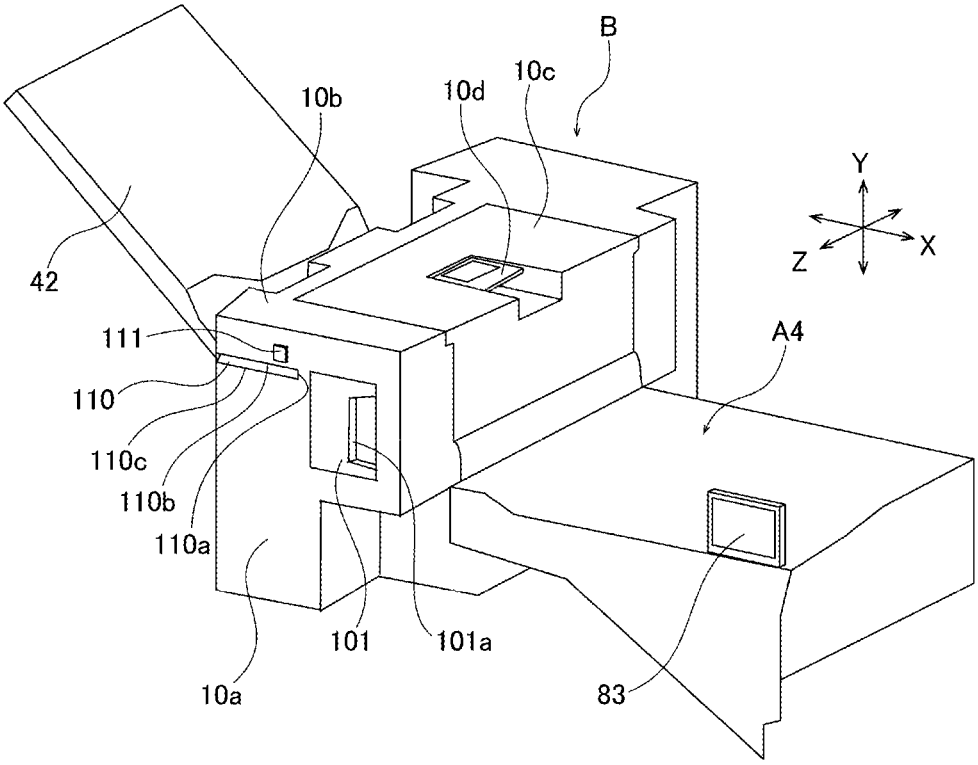
FIG. 6 is a perspective view of the sheet processing apparatus.
Figure 7:
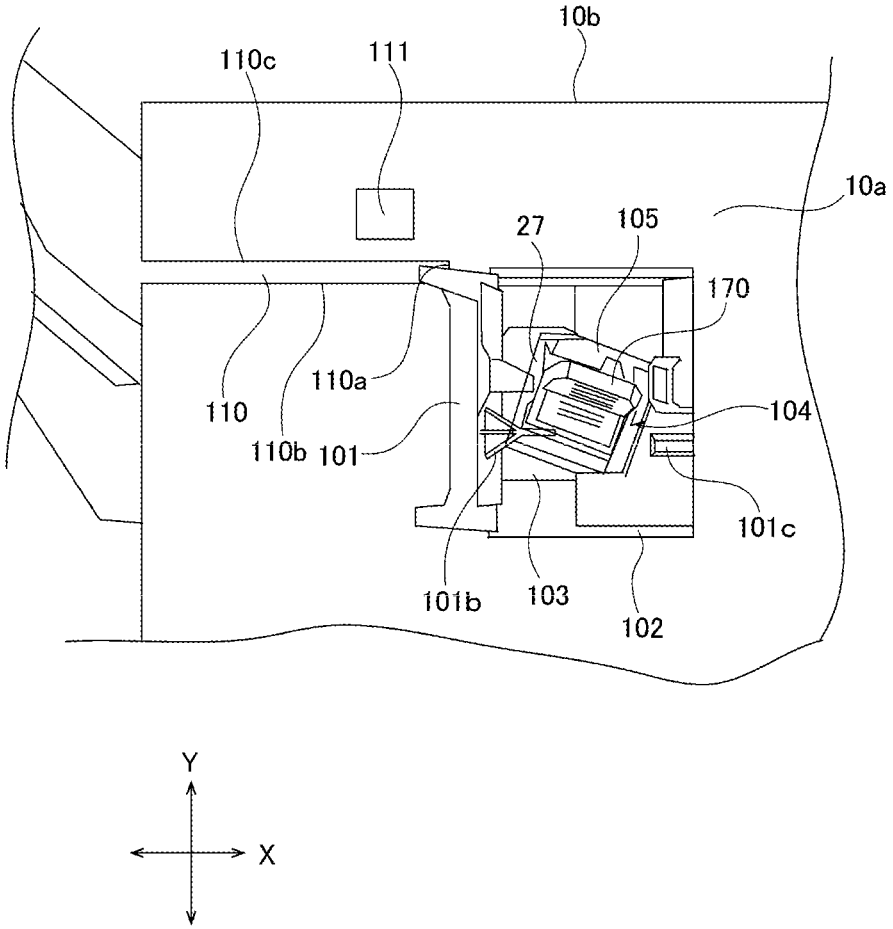
FIG. 7 is a front view of the sheet processing apparatus in a state in which an opening/closing door is open.
Figure 8:
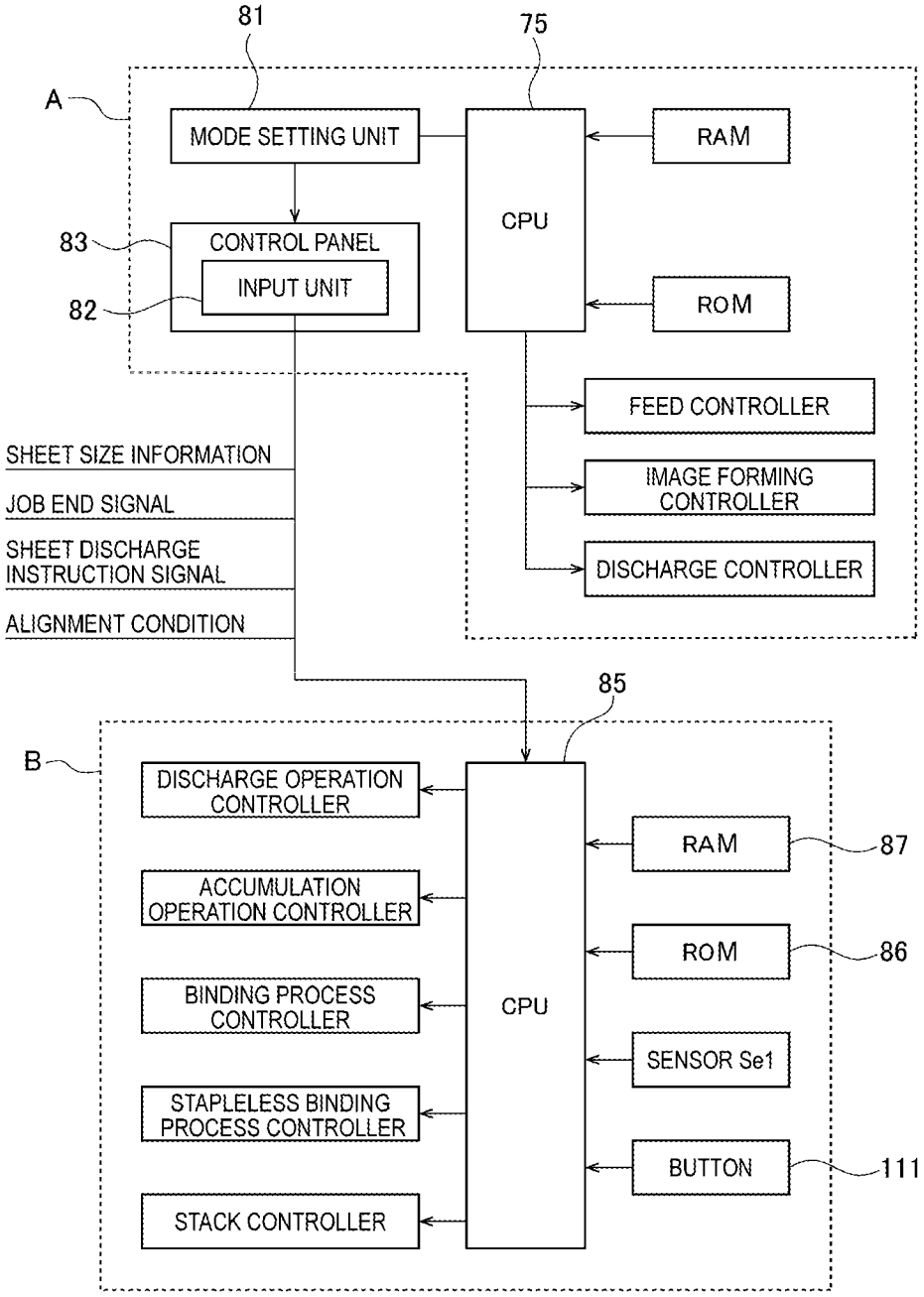
FIG. 8 is a control block diagram.

FIG. 6 is a perspective view of the sheet processing apparatus B and the relay conveying unit A4. FIG. 7 is a front view of the sheet processing apparatus B as viewed from the front side, and is a view illustrating a state in which an opening/closing cover 101 to be described later is open. The sheet processing apparatus B includes at least a front cover 10*a*, a top cover 10*b*, and a rear cover (not illustrated). Each cover is not necessarily a flat surface, and may have a curved surface. In the present embodiment, the front cover 10*a* is a cover of a portion covering the front side with respect to the front sheet metal 30*f*. In the present embodiment, the front cover 10*a* is illustrated as one member, but even if the cover is divided into a plurality of parts, an exterior cover positioned on the front side with respect to the front sheet metal 30*f* is referred to as the front cover. Similarly, as for the top cover, all the members covering the upper surface of the frame (not illustrated) positioned on the upper side of the apparatus frame F are referred to as the top cover. Similarly, in the rear cover, all the members covering the rear side of the rear sheet metal 30*r* of the apparatus frame F are referred to as the rear cover.

An opening 102 (FIG. 7) is formed in the front cover 10*a*, and an opening/closing cover 101 that covers the opening 102 is provided. The opening/closing cover 101 is provided with a handle 101*a*. The user can open and close the opening/closing cover 101 by operating the handle 101*a* to access the staple cartridge 170 of the stapling unit 17. The insertion port 110 and the button 111 described above are provided on the left side of the opening/closing cover 101 in the direction of arrow X (the downstream side in the discharge direction in which the sheet on the processing portion 15 is discharged to the stack tray 40).

The insertion port 110 has a slit shape extending in the direction of arrow X in the front cover 10*a*, and includes an upper regulating portion 110*b* that regulates the upper surface of the sheet bundle MS, a lower regulating portion 110*c* that regulates the lower surface of the sheet bundle MS, and a right regulating portion 110*a* against which the right end of the sheet bundle MS abuts.

A protrusion 101*b* is provided inside the opening/closing door, and a tip of the protrusion 101*b* is configured to be fitted into a recess 101*c*. The protrusion 101*b* is inserted into the recess 101*c* provided in the front cover 10*a* in the closed state of the opening/closing cover 101. Here, whether the opening/closing cover 101 is in the open state or the closed state is detected by a detection mechanism (not illustrated) that detects whether the protrusion 101*b* is inserted into the recess 101*c*.

When the user opens the opening/closing cover 101, the opening 102 provided in the front cover 10*a* is exposed. A substantially cylindrical (tunnel-shaped) shielding member 103 is formed from the opening 102 toward the rear side. An opening 105 is provided on the rear side with respect to the shielding member 103.

The opening 105 of the shielding member 103 is formed at a position (front side) facing the front opening 31*f* of the front sheet metal 30*f*. The staple cartridge 170 can be removed from the stapling unit 17 through the substantially cylindrical portion of the shielding member 103 via the opening 105. In the present embodiment, a portion of the front cover 10*a* other than the opening/closing cover 101 is an example of the first cover portion, and the opening/closing cover 101 is an example of the second cover portion. The substantially cylindrical portion of the shielding member 103 is an example of a passing portion.

When the stapling unit 17 is positioned in the cartridge replacement position, a portion of the staple cartridge 170 protrudes through the opening 105 so that the user can access the staple cartridge 170 by hand through the opening 102. That is, a region (staple cartridge passage region) 104 between the opening 105 and the opening 102 in the front-rear direction and covered with the shielding member 103 is a region through which the staple cartridge 170 passes at the time of replacement of the staple cartridge 170. As described above, in a state where the stapling unit 17 is positioned at the cartridge replacement position, a portion of the stapling unit 17 (specifically, the staple cartridge 170) is positioned on the front side with respect to the opening 105. Thus, it is possible to improve workability when the user replaces the staple cartridge 170.

A portion of the shielding member 103 on the left side in the direction of arrow X is referred to as a shielding portion 103*a*. The staple-less binding unit 27 is arranged on the opposite side with respect to the staple cartridge passage region 104 with respect to the shielding portion 103*a* in the sheet conveying direction (direction of arrow X). This prevents the user from erroneously touching the staple-less binding unit 27 when replacing the staple cartridge 170. Therefore, there is no possibility that the harness 131 is pulled out or the position of the staple-less binding unit 27 is shifted due to erroneous touch by the user when the staple cartridge 170 is replaced. Note that the shielding member 103 may be a complete wall member, or may have a hole that does not allow the user's finger to pass therethrough, and may be configured not to touch the staple-less binding unit 27 when the user inserts his/her hand through the opening 102 when performing the replacement operation of the staple cartridge 170. Furthermore, in the present embodiment, the harness 131 described above is arranged outside the shielding member 103 with respect to the staple cartridge passage region 104 so that the user cannot touch the harness 131.

Note that a configuration in which the left shielding portion 103*a* of the shielding member 103 can be detached or open and closed to enable maintenance of the staple-less binding unit 27 may be adopted.

The top cover 10*b* of the sheet processing apparatus B is provided with an opening/closing cover 10*c*, and the user can open and close the opening/closing cover 10*c* by gripping the handle 10*d*. The opening/closing cover 10*c* may be open and closed in a vertical direction or an oblique direction by a link mechanism (not illustrated), or may be open and closed so as to rotate in a counterclockwise direction or a clockwise direction using a rotation shaft (not illustrated). By making the opening/closing cover 10*c* openable and closable, the accumulated sheet can be removed when a jam occurs in the sheet conveying path 11.

Control Configuration

A control configuration of the image forming system illustrated in FIG. 1 will be described with reference to FIG.

8. A control CPU 75 is provided in the image forming apparatus A, and a ROM 76 storing an operation program and a RAM 77 storing control data are connected to the control CPU 75. The control CPU 75 is provided with a feed controller 78, an image forming controller 79, and a discharge controller 80. At the same time, a mode setting unit 81 and a operation portion 83 including an input unit 82 are connected to the control CPU 75.

The control CPU 75 is configured to select a "print-out mode", a "shift mode", and a "post-processing mode". The "print-out mode" is a mode in which a sheet on which an image is formed is discharged to the stack tray 40 without any processing. The "shift mode" is a mode in which the sheet bundle discharged to the stack tray 40 is discharged so as to be shifted in the sheet width direction for each portion. The "post-processing mode" is a mode in which sheets on which images have been formed are stacked on the sheet stacking table 16, bound by the stapling unit 17, and then discharged to the stack tray 40.

The sheet processing apparatus B is provided with a post-processing control CPU 85, and a discharge operation controller, an accumulation operation controller that accumulates sheets in the processing portion 15, a binding process controller, a staple-less binding process controller by the staple-less binding unit 27, and a stack controller are connected to the post-processing control CPU 85.

Figure 9:
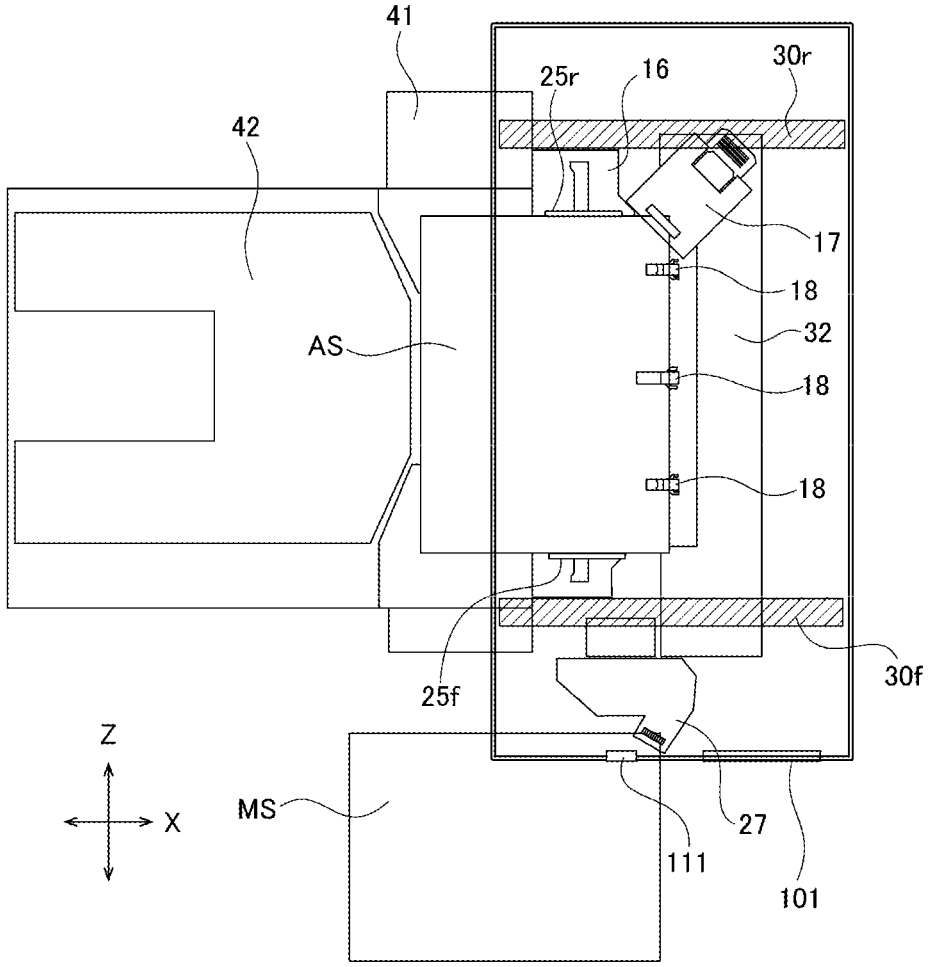
FIG. 9 is a top view of a stack tray and a process tray.

In the sheet processing apparatus B of the present embodiment, the staple-less binding unit 27 is provided on the front side with respect to the processing portion 15 of the sheet processing apparatus B. Therefore, as illustrated in FIG. 9, the staple-less binding process by the staple-less binding unit 27 can be executed while each operation of the "print-out mode", the "shift mode", and the "post-processing mode" is being executed.

When the staple binding process by the stapling unit 17 and the staple-less binding process by the staple-less binding unit 27 are simultaneously executed, the peak current may exceed the maximum value of the power supply specification of the sheet processing apparatus B. For example, in the case of using a power supply in which the maximum value of the peak current of the power supply specification is 10 A, the peak current when the staple-less binding process is executed and the motor 128 moves the pressing portion 127 to the binding position is about 3 A, and the peak current during the execution of the staple binding process is about 8 A. If these processes are executed simultaneously, the peak current exceeds 10 A, which is the upper limit value of the peak current of the power supply specification.

Figure 10:
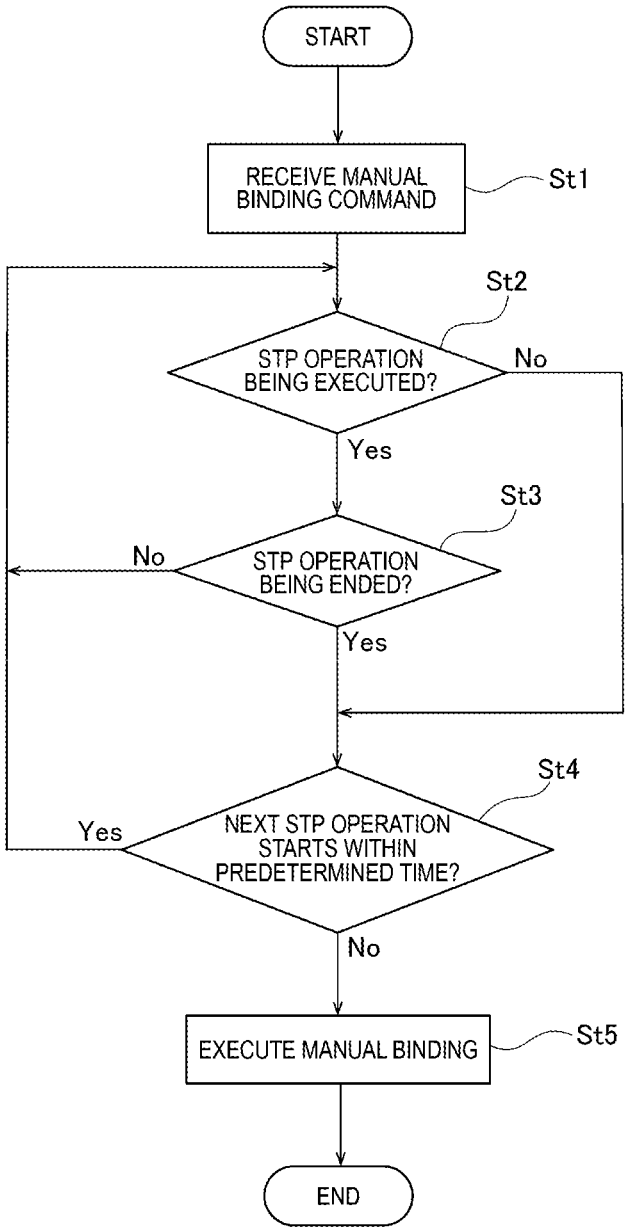
FIG. 10 is a flowchart of a staple-less binding process.

In this case, simultaneous execution of the staple-less binding process (automatic stapling) by the stapling unit 17 and the staple-less binding process (manual binding) by the staple-less binding unit 27 may be prohibited. FIG. 10 is a flowchart when the staple-less binding process (manual binding) is executed.

When the post-processing control CPU 85 detects that the button 111 has been pressed or that a predetermined time has elapsed since the sheet bundle MS was inserted into the insertion port 110 and receives a manual binding start command (step St1), it is determined whether a stapling (STP) operation by the stapling unit 17 is being executed (step St2). In a case where the stapling operation is being executed, it is determined in step St3 whether the stapling operation has ended. After the stapling operation ends, it is determined whether the next stapling operation starts within a predetermined time (for example, two seconds) (step St4). In a case where the stapling operation is not executed within the predetermined time, the manual binding by the staple-less binding unit 27 is executed (step St5).

When determining that the stapling operation is not being executed in step St2, the post-processing control CPU 85 proceeds to step St4 and determines whether the stapling operation is started within a predetermined time. In a case where it is determined in step St4 that the stapling operation is to be executed within the predetermined time, the execution of the manual binding by the staple-less binding unit 27 is waited, and the staple binding process by the stapling unit 17 is prioritized.

The predetermined time described above is a time during which the staple-less binding process is executed by the staple-less binding unit 27, and specifically, is a time during which the motor 128 moves the pressing portion 127 to the binding position. Since the peak current while the pressing portion 127 moves from the binding position to the separation position is lower than that at the time of pressing, there is no problem even if the staple-less process is executed simultaneously with the stapling process while the pressing portion 127 performs the separation operation.

Note that, depending on the power supply specification, when the staple-less binding process and the shift sorting processing are simultaneously performed, the upper limit may be exceeded. In this case, the staple-less binding process, the shift sorting processing, and the stapling process may not be simultaneously performed. In addition, since the motors operating at the same time are different depending on the sheet size, even if the same processing is performed, the processing may or may not be performed at the same time as the staple-less binding process. Therefore, whether simultaneous execution can be performed may be determined depending on the sheet size.

Second Embodiment

Figure 11:
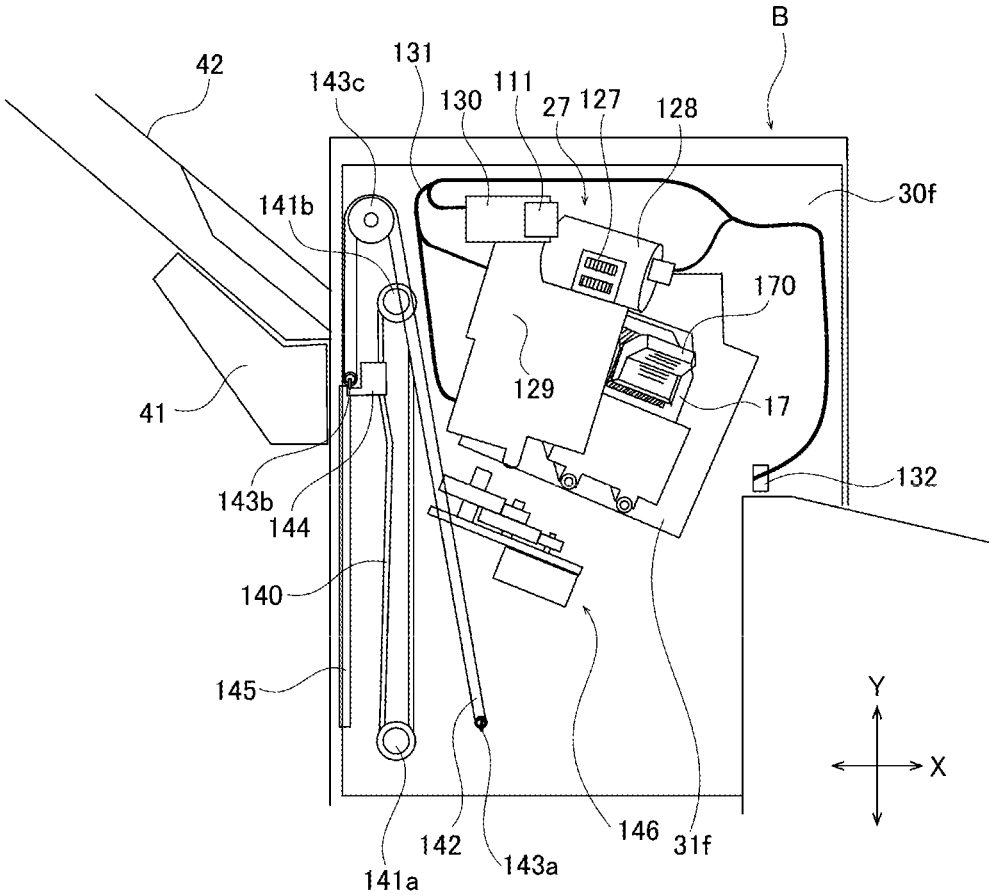
FIG. 11 is a front view of a second embodiment.
Figure 12:
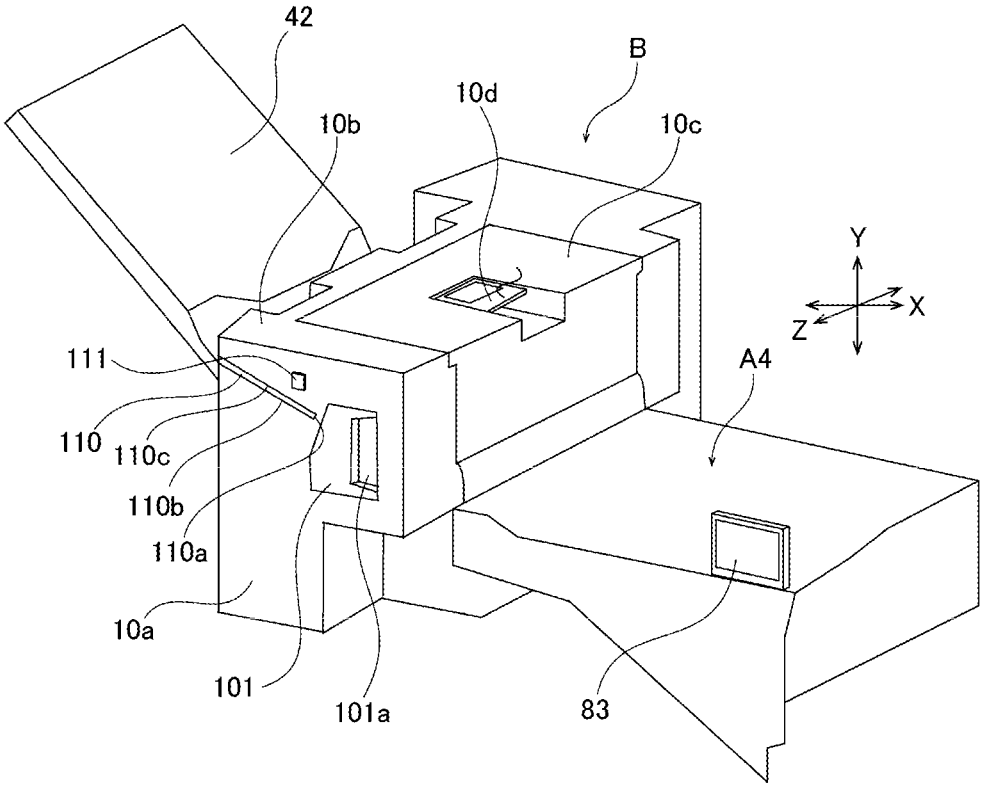
FIG. 12 is a perspective view of the second embodiment.
Figure 13:
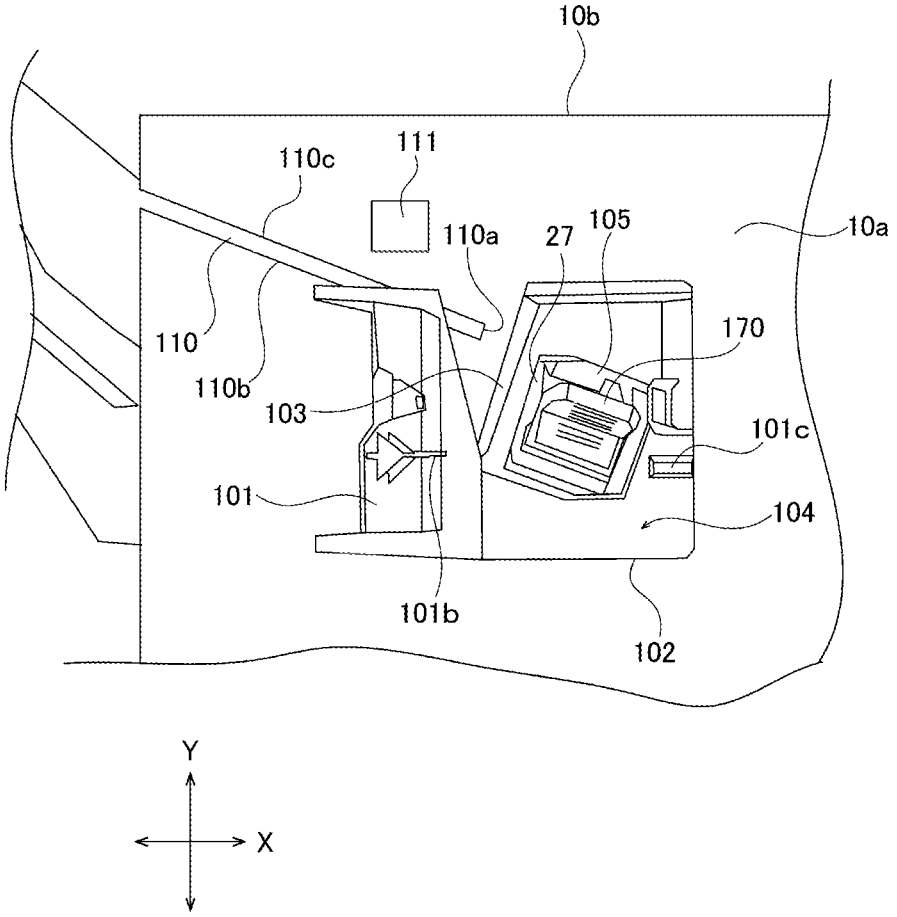
FIG. 13 is a front view of the second embodiment.

In the sheet processing apparatus illustrated in FIGS. 11 to 13, the insertion port 110 is disposed so as to be substantially parallel to the angle of the sheet stacking table 16 of the processing portion 15. The same reference numerals are given to the same configurations as those of the first embodiment described above, and the description thereof will be omitted. In this case, the angle of the sheet abutting surface of the pressing portion 127 is made substantially parallel to the angle of the sheet stacking table 16 by arranging the staple-less binding unit 27 illustrated in FIG. 5 in a state of being rotated in the clockwise direction. As a result, since the pressing portion 127 is disposed on the right side in the direction of arrow X, the shape of the opening/closing cover 101 is different from that of the first embodiment, and the upper left portion of the opening/closing cover 101 is shaped to escape the insertion port 110.

As in the above-described embodiment, the button 111 is disposed above the insertion port 110, on the right side in the direction of arrow X with respect to the central portion of the insertion port 110, and on the left side in the direction of arrow X with respect to the right regulating portion 110*a* (disposed on the front cover 10*a*). Even in such a configuration, in a state where the stapling unit 17 is positioned at the cartridge replacement position, a portion of the stapling unit 17 (specifically, the staple cartridge 170) is positioned on the front side with respect to the opening 105. Thus, it is possible to improve workability when the user replaces the staple cartridge 170. Also in the present embodiment, a portion of the front cover 10*a* other than the opening/closing cover 101 is an example of the first cover portion, and the opening/closing cover 101 is an example of the second cover portion.

Further, the staple-less binding unit 27 is disposed at a position overlapping a portion (specifically, the staple cartridge 170) of the stapling unit 17 positioned at the cartridge replacement position in the front-rear direction of the sheet processing apparatus B. As a result, the size in the front-rear direction of the sheet processing apparatus B can be reduced as compared with the configuration in which the staple-less binding unit 27 is arranged on the front side with respect to the stapling unit 17 in the state of being positioned on the most front side. Therefore, it is possible to provide a sheet processing apparatus capable of performing manual binding by the staple-less binding unit on the front side of the sheet processing apparatus B and capable of replacing the staples of the stapling unit 17 on the front side. In such a sheet processing apparatus B, the size of the apparatus in the front-rear direction can be reduced.

Third Embodiment

Figure 14:
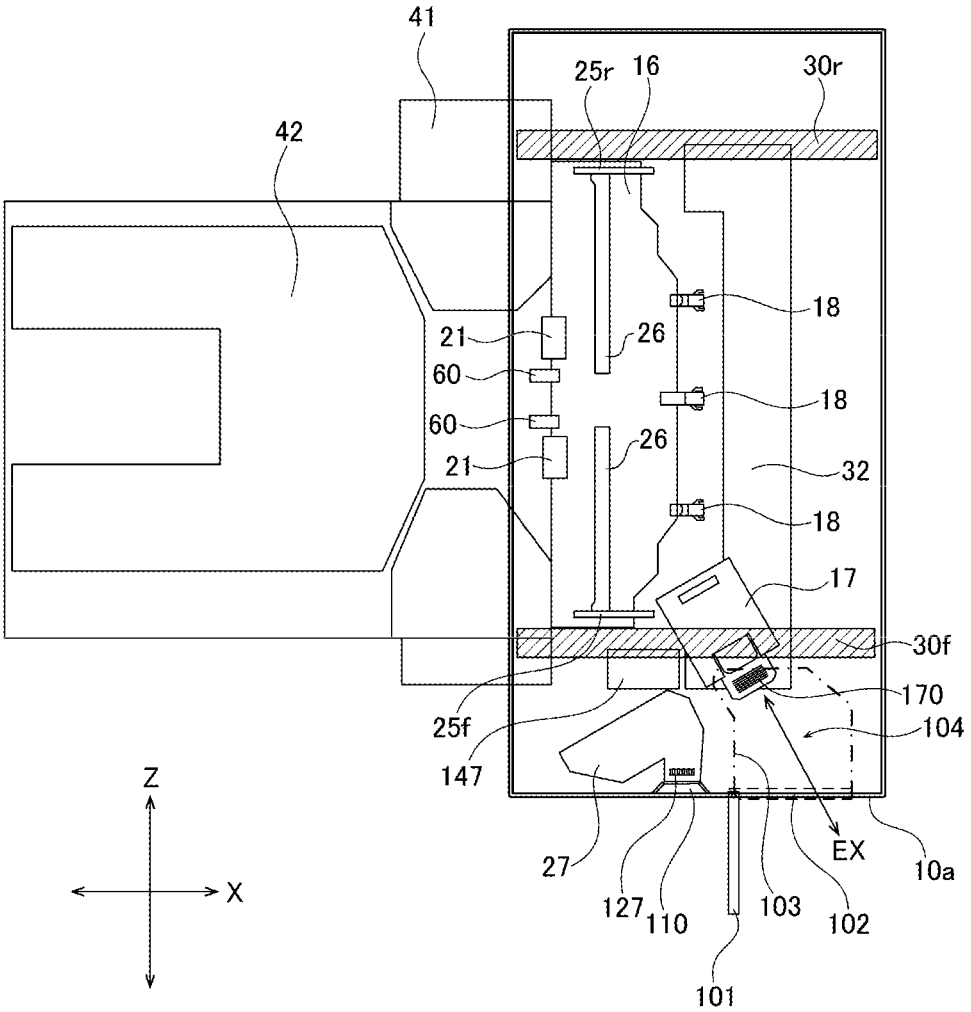
FIG. 14 is a top view of a third embodiment.
Figure 15:
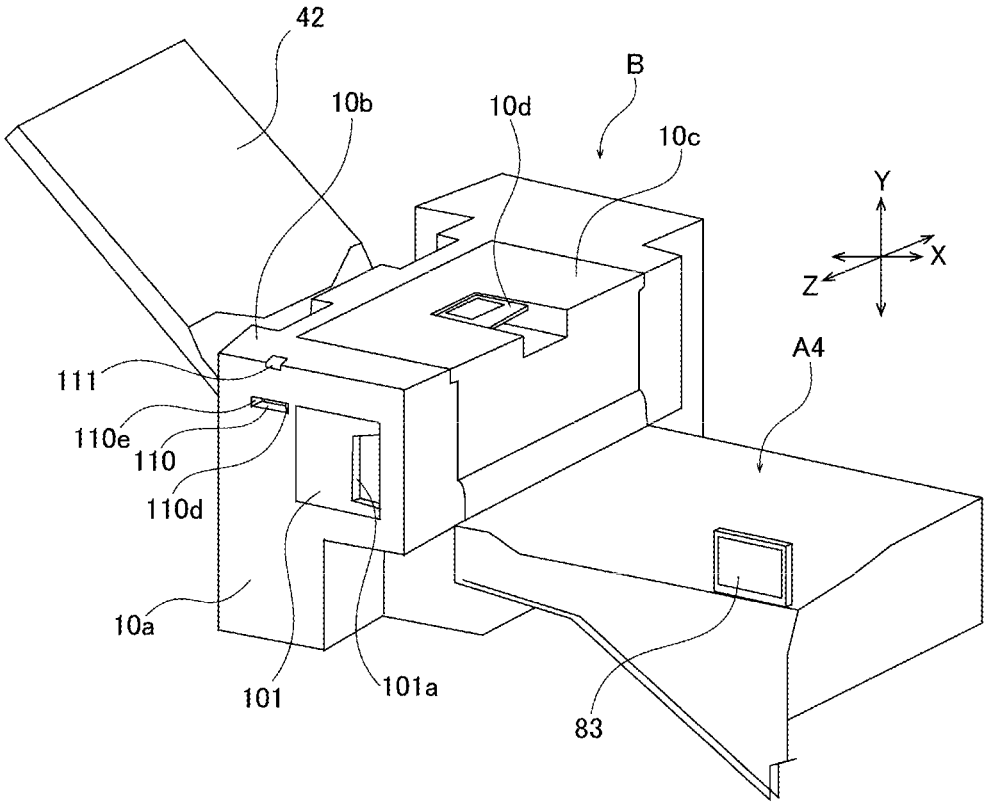
FIG. 15 is a perspective view of the third embodiment.
Figure 16:
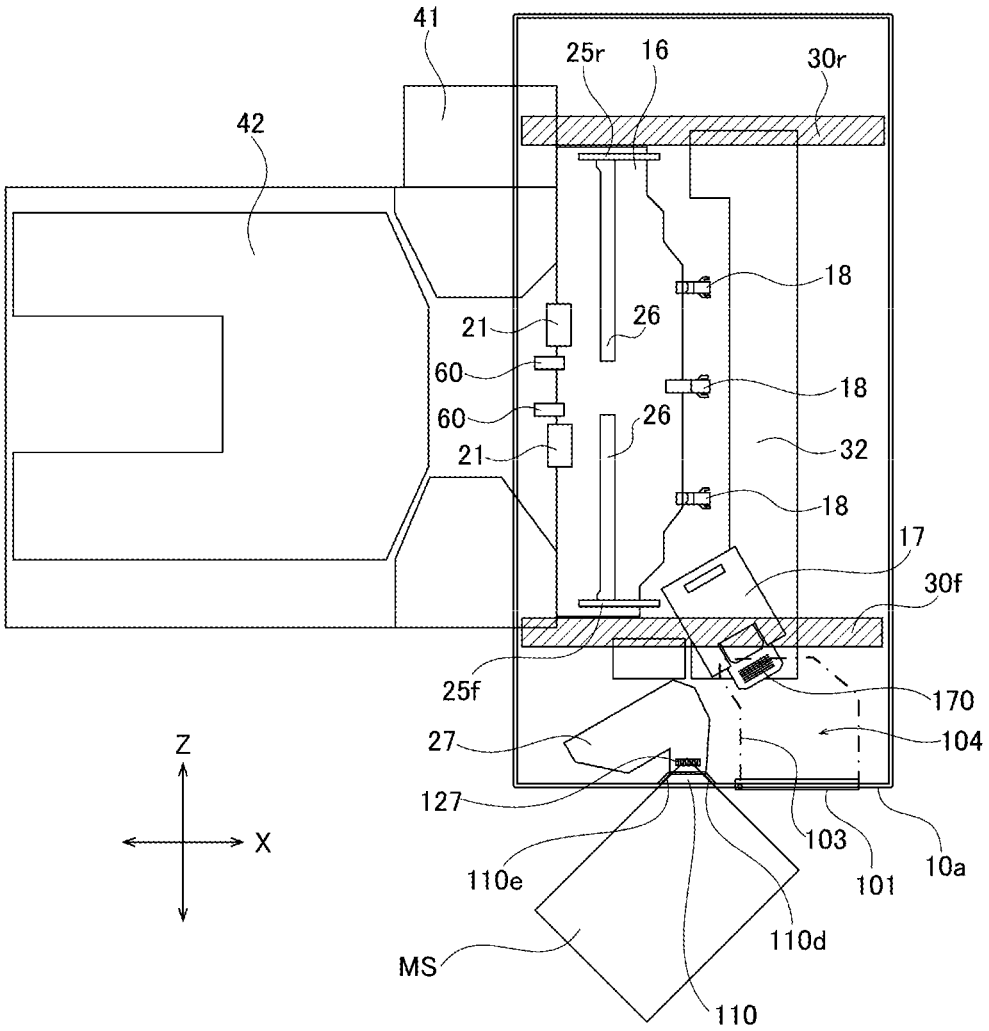
FIG. 16 is a top view of the third embodiment.

FIGS. 14 to 16 illustrate an embodiment in which the right abutting portion 110*d* and the left abutting portion 110*e* of the regulating port 110 are arranged between the left end and the opening/closing cover 101 in the front cover 10*a*. The same reference numerals are given to the same configurations as those of the first embodiment described above, and the description thereof will be omitted. In this case, the staple-less binding unit 27 is disposed so as to be substantially parallel to the cover surface of the front cover 10*a* of the pressing portion 127 of the staple-less binding unit 27, and the corner of the sheet bundle MS is inserted into the insertion port 110 to form a binding mark of approximately 45 degrees at the corner of the sheet bundle MS. When the user inserts the corner portion of the sheet bundle MS into the insertion port 110, the user inserts the right end of the sheet bundle MS into the right abutting portion 110*d* and the left end of the sheet bundle MS into the left abutting portion 110*e*. That is, the extension line of the abutting surface of the right abutting portion 110*d* and the extension line of the abutting surface of the left abutting portion 110*e* are in an arrangement relationship of intersecting at approximately 90 degrees. As described above, by making the insertion port 110 smaller than the other embodiments, it is clear to which position the sheet bundle is to be inserted, so that it is possible to improve the operability when the user manually binds the sheets.

The button 111 is disposed vertically above the center of the insertion port 110, extending from the top cover 10*b* to the front cover 10*a*. In this manner, since the user can press the button 111 in the oblique direction, workability at the time of operation can be improved. Even in such a configuration, in a state where the stapling unit 17 is positioned at the cartridge replacement position, a portion of the stapling unit 17 (specifically, the staple cartridge 170) is positioned on the front side with respect to the opening 105. Thus, it is possible to improve workability when the user replaces the staple cartridge 170.

Further, the staple-less binding unit 27 is disposed at a position overlapping a portion (specifically, the staple cartridge 170) of the stapling unit 17 positioned at the cartridge replacement position in the front-rear direction of the sheet processing apparatus B. As a result, the size in the front-rear direction of the sheet processing apparatus B can be reduced as compared with the configuration in which the staple-less binding unit 27 is arranged on the front side with respect to the stapling unit 17 in the state of being positioned on the most front side. Therefore, it is possible to provide a sheet processing apparatus capable of performing manual binding by the staple-less binding unit on the front side of the sheet processing apparatus B and capable of replacing the staples of the stapling unit 17 on the front side. In such a sheet processing apparatus B, the size of the apparatus in the front-rear direction can be reduced.

Fourth Embodiment

Figure 17:
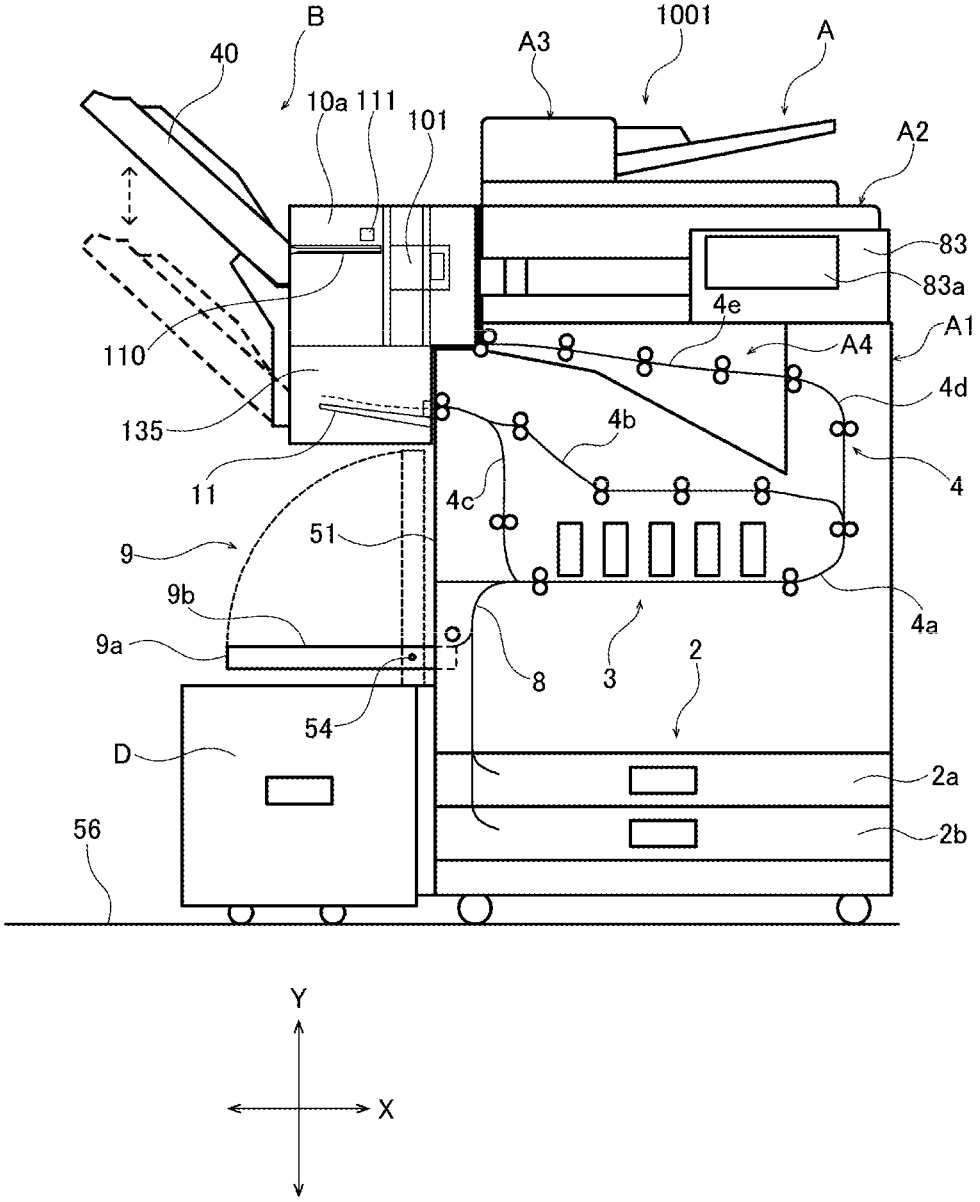
FIG. 17 is an explanatory diagram of an overall configuration of an image forming system according to a fourth embodiment.

An image forming system 1001 of the fourth embodiment illustrated in FIG. 17 is different from the image forming system 1000 of the first embodiment in the configurations of the front cover 10*a*, the top cover 10*b*, the opening/closing cover 101, and the shielding member. Since other configurations and operations are similar to those of the image forming system 1000 of the first embodiment, the same reference numerals are given and detailed description thereof is omitted.

Figure 18:
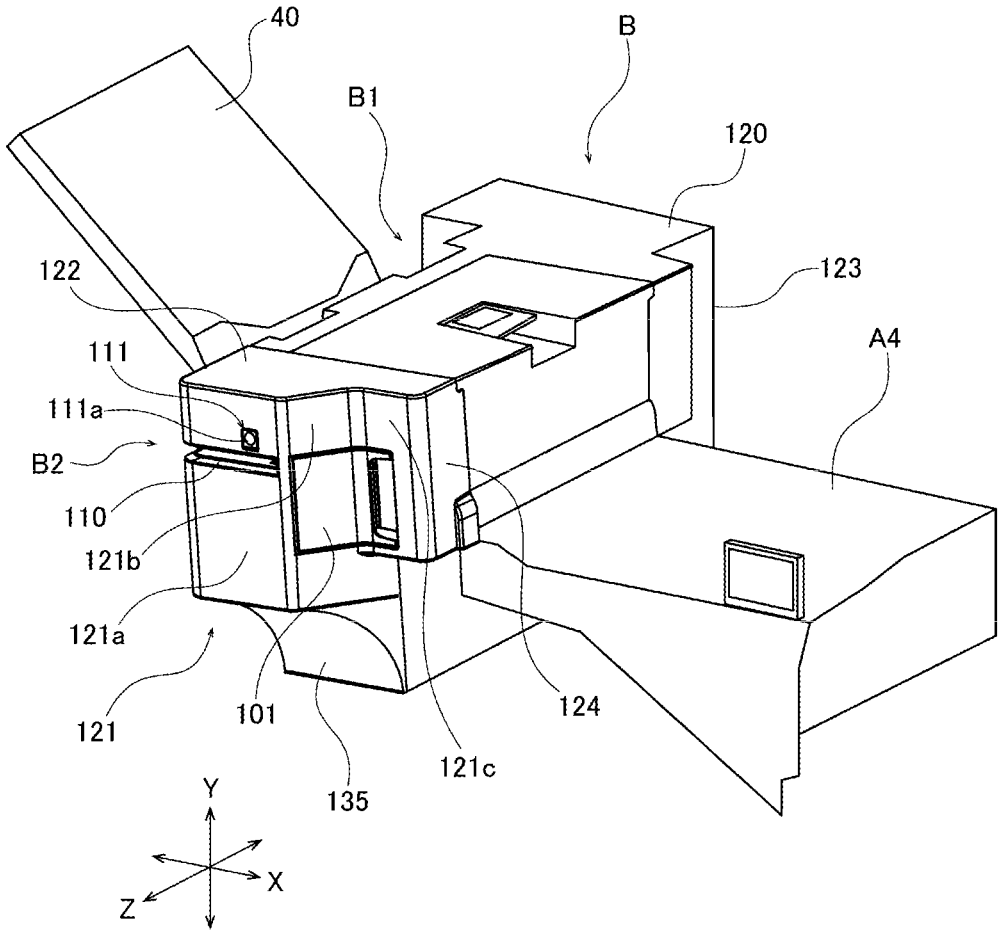
FIG. 18 is a perspective view of a sheet processing apparatus according to the fourth embodiment.
Figure 19:
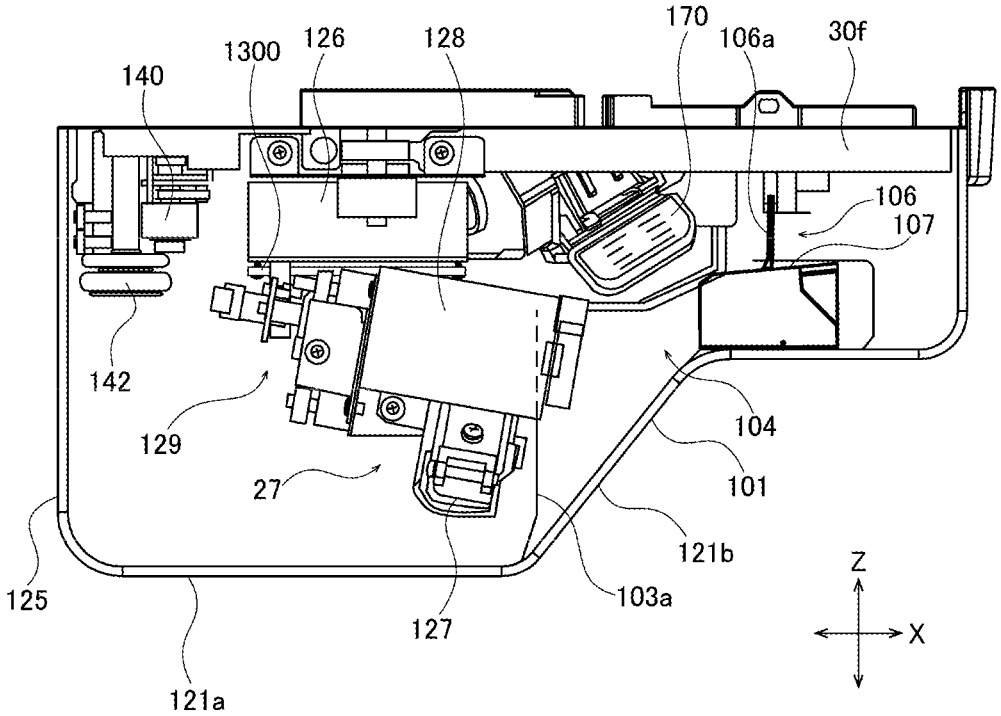
FIG. 19 is a top view of a sheet processing apparatus according to the fourth embodiment.

As illustrated in FIGS. 18 and 19, the exterior cover of the sheet processing apparatus B of the fourth embodiment includes a front cover 121, a top cover 120, a rear cover 123, a main cover 124, and a stack-tray-side cover 125. A top cover 122 is provided in a front-side portion of the top cover 120, and the user can align the sheet bundle MS inserted into the insertion port 110 with the top cover 122. The front cover 121 is disposed substantially parallel to the front sheet metal 30*f*, and includes a first surface 121*a* on which the insertion port 110 is formed, a second surface 121*b* inclined from the first surface 121*a* toward the rear side on the right side of the first surface 121*a*, and a third surface 121*c* substantially parallel to the first surface 121*a* on the rear side of the first surface 121*a*. On the lower side of the first surface 121*a*, a retraction surface 135 retracted to the rear side of the first surface 121*a* is formed.

An insertion port 110 is formed in the first surface 121*a* of the front cover 121, and a button 111 is disposed above the insertion port 110. Since the insertion port 110 is formed in the first surface 121*a*, the pressing portion 127 of the staple-less binding unit 27 is provided between the first surface 121*a* and the front sheet metal 30*f*. Also in the present embodiment, a portion of the front cover 121 other than the opening/closing cover 101 is an example of the first cover portion, and the opening/closing cover 101 is an example of the second cover portion.

Figure 20:
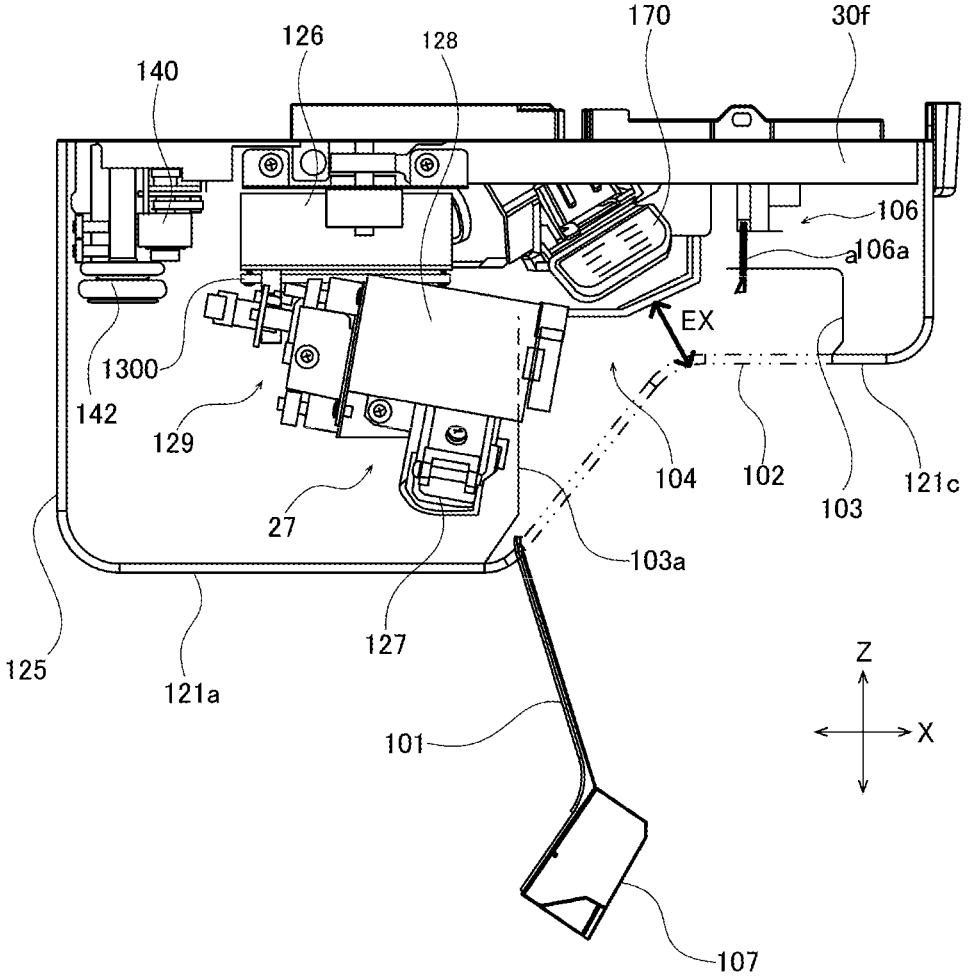
FIG. 20 is a top view of a sheet processing apparatus according to the fourth embodiment, illustrating a state in which an opening/closing door is open.

FIGS. 19 and 20 are top views of a portion of the stapling unit 17 and the staple-less binding unit 27 in a state of being at the cartridge replacement position. A bracket 126 is fixed to the front sheet metal 30*f*. A staple-less binding unit 27 is attached to the bracket 126. The staple-less binding unit 27 includes a pressing portion 127, a motor 128, a drive transmission portion 129, and a substrate 1300. As illustrated in FIG. 19, the staple cartridge 170 of the stapling unit 17 at the cartridge replacement position is arranged on the right side (right side in the direction of arrow X) with respect to the pressing portion 127 of the staple-less binding unit 27 on the rear side in the direction of arrow Z. Also in the present embodiment, the staple cartridge passage region 104 is formed of the shielding member 103, and the staple-less binding unit 27 is arranged on the opposite side of the staple cartridge passage region 104 by the shielding portion 103*a* which is the portion on the left side in the direction of arrow X of the shielding member 103. That is, in a state where the opening/closing cover 101 is open, the staple-less binding unit 27 is shielded by the shielding member 103 so as not to be seen from the outside of the apparatus. Therefore, the staple cartridge 170 passing through the staple cartridge passage region 104 and the user's finger do not abut. Therefore, there is no possibility that the harness (not illustrated) is pulled out or the position of the staple-less binding unit 27 is shifted due to erroneous touch by the user when the staple cartridge 170 is replaced.

The opening/closing cover 101 of the present embodiment is provided so as to close the opening 102 formed from the second surface 121*b* to the third surface 121*c* of the front cover 121. The opening/closing cover 101 has a rotation shaft on the second surface 121*b* side. The opening/closing cover 101 is in an open state (FIG. 20) when rotated in a clockwise direction in FIG. 19 around the rotation shaft, and is in a closed state (FIG. 19) when rotated in a counter-clockwise direction to close the opening 102.

In the present embodiment, the third surface 121*c* is arranged on the right side of the first surface 121*a* (on the staple cartridge passage region 104 side of the staple-less binding unit 27 in the direction of arrow X), the third surface 121*c* is arranged on the rear side of the first surface 121*a*, and the second surface 121*b* connecting the first surface 121*a* and the third surface 121*c* is provided. The opening/closing cover 101 is provided extending from the second surface to the third surface. Therefore, as compared with the aspect in which the opening/closing cover 101 (that is, the opening 102) is provided at the same position as the first surface 121*a* in the front-rear direction as described in the first embodiment, the shortest distance from the opening 102 to the staple cartridge 170 at the cartridge replacement position is shortened. In other words, the length of the staple cartridge passage region 104 in the direction of arrow EX (cartridge removal/insertion direction) is short. Accordingly, operability at the time of staple replacement can be improved.

Figure 21:
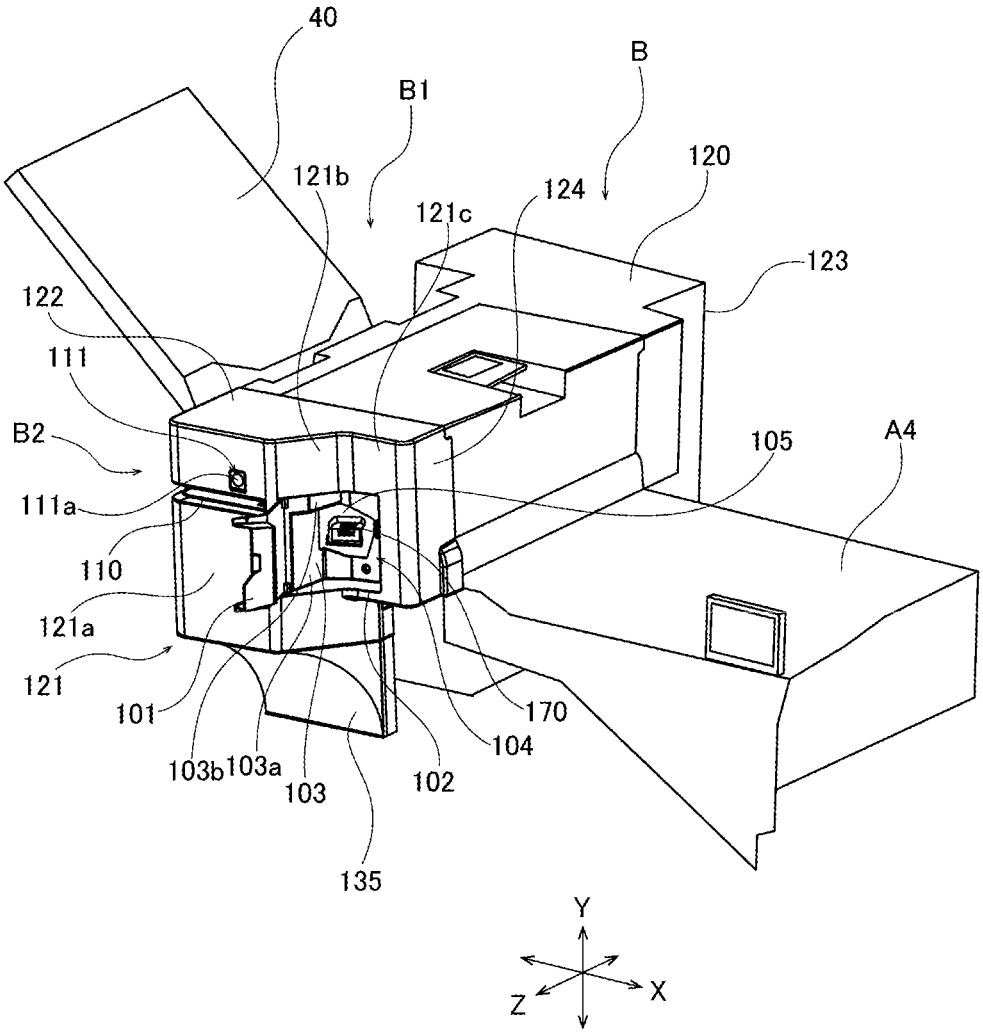
FIG. 21 is a perspective view of a sheet processing apparatus according to the fourth embodiment, illustrating a state in which an opening/closing door is open.

FIG. 21 is a perspective view of the sheet processing apparatus B in which the opening/closing cover 101 is in an open state. When the opening/closing cover 101 is in the open state, the user can visually recognize the staple cartridge 170 protruding toward the front side from the rear opening 105 of the shielding member 103 through the staple cartridge passage region 104 from the opening 102. In the shielding member 103 forming the staple cartridge passage region 104, a protrusion 103*b* protruding toward the right side of the shielding portion 103*a* is formed above the left shielding portion 103*a*. The motor 128 of the staple-less binding unit 27 is disposed inside the protrusion 103*b* (inside the sheet processing apparatus B).

Since the motor 128 is disposed above the staple cartridge 170 at the cartridge replacement position in the vertical direction, even if the upper portion of the staple cartridge passage region 104 is somewhat narrowed by the protrusion 103*b* that shields the motor 128 from the outside of the apparatus, the staple cartridge 170 passes therebelow, and there is no problem. Therefore, the motor 128 can be protected without impairing the workability when the user replaces the staple cartridge 170.

An opening/closing detection sensor 106 (FIG. 20) for detecting an open or closed state of the opening/closing cover 101 is disposed inside the opening 102 (on the rear side). The opening/closing detection sensor 106 is a switch-type sensor. The opening/closing detection sensor 106 includes a pressing pin 106*a* spring-biased from the rear side toward the front side, and determines that the opening/closing cover 101 is in the closed state when the pressing pin 106*a* is in contact with the opening/closing detection sensor 106 by being pressed by a locking portion 107 provided on the opening/closing cover 101. On the other hand, when the opening/closing cover 101 is open, the pressing of the pressing pin 106*a* by the locking portion 107 is released, and the pressing pin 106*a* is biased by the spring and protrudes toward the front side. As a result, it is determined that the pressing pin 106*a* is separated from the opening/closing detection sensor 106 and the opening/closing cover 101 is in the open state.

In the image forming system 1001 of the present embodiment, the manual feeding portion 9 is disposed below the sheet processing apparatus B. Since the user sets the sheet on the stacking surface 9*b* of the manual feeding portion 9, the visibility of the manual feeding portion 9 is improved by forming the retraction surface 135.

Figure 22:
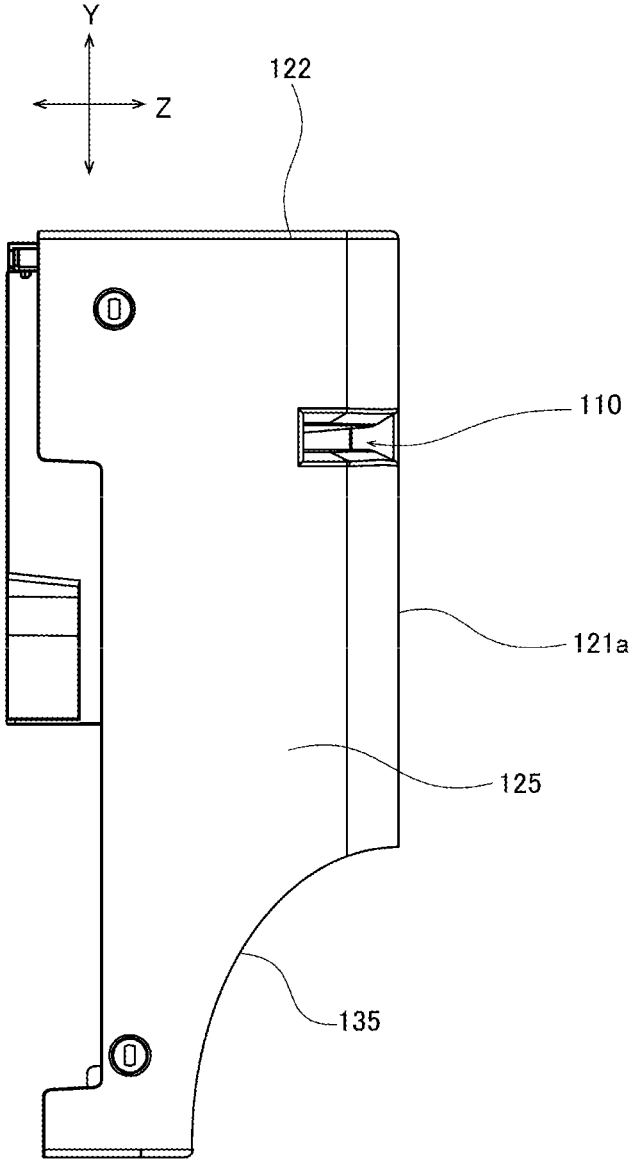
FIG. 22 is a view of a sheet processing apparatus according to the fourth embodiment as viewed from a stack tray side.

The retraction surface 135 is formed downward and toward the rear side from the lower end of the first surface 121*a* of the front cover 121, and may be a curved surface as illustrated in FIGS. 18 and 22 or may be formed in a linear shape. In addition, the retraction surface 135 may be formed in an L-shape so as to be directed toward the rear side substantially in parallel with the top cover 122 from the lower end of the first surface 121*a* and bent downward perpendicularly therefrom. In the present embodiment, members for operating the automatic binding unit B1, such as a guide rail 145 for lifting and lowering the stack tray 40, a towing member 140, a wind-up pulley 141*a*, a spring 142, and one end 143*a* of the spring, are arranged inside the retraction surface 135 (on the front sheet metal 30*f* side). In other words, the staple-less binding unit 27 is disposed inside the first surface 121*a* protruding toward the front side, and the processing portion 15 including the stapling unit 17 is disposed inside the portion on the rear side of the staple-less binding unit 27 and the third surface 121*c* and the retraction surface 135 formed on the rear side of the first surface 121*a*.

FIGS. 23A to 23E are schematic cross-sectional views of the insertion port 110 as viewed from above. FIGS. 23A to 23E illustrate an insertion detection sensor mechanism 112 that detects whether the sheet bundle MS is set at the binding position of the insertion port 110. The insertion detection sensor mechanism 112 includes a right sensor mechanism 112*a* and a rear sensor mechanism 112*b*. The right sensor mechanism 112*a* and the rear sensor mechanism 112*b* include levers 113*a* and 113*b*, sensor flags 114*a* and 114*b*, rotation shafts 115*a* and 115*b*, and sensors 116*a* and 116*b* (transmissive sensors) on which sheets abut, respectively.

The right sensor mechanism 112*a* is a sensor mechanism corresponding to the right regulating portion 110*a*, and detects whether the sheet bundle MS inserted into the insertion port 110 abuts on the right regulating portion 110*a* (or the movable regulating surface 117). The rear sensor mechanism 112*b* is a sensor mechanism corresponding to the rear regulating surface 110*f*, and detects whether the sheet bundle MS abuts against the rear regulating surface 110*f*. When it is detected that the sheet bundle MS abuts on each regulating surface by both sensor mechanisms, the controller described later determines that the sheet bundle MS is set at the correct binding position, and determines that the staple-less binding unit 27 can execute the staple-less binding process.

Since the sensor mechanisms have the same configuration, the rear sensor mechanism 112*b* will be described here. The lever 113*b* and the sensor flag 114*b* are formed on the rotation shaft 115*b*. When the rotation shaft 115*b* rotates, the lever 113*b* and the sensor flag 114*b* also rotate. The rotation shaft 115*b* is provided with a spring member (not illustrated), and is biased by a spring so as to be in the state of FIG. 23A when the sheet does not abut on the rotation shaft.

When the sheet bundle MS is inserted into the insertion port 110 and the rear-side end of the sheet bundle MS abuts on the lever 113*b* (FIG. 23C), the rotation shaft 115*b* rotates against the biasing force of the spring member, the sensor flag 114*b* moves to a position to block the optical axis of the sensor 116*b*, and it is detected that the sheet bundle MS abuts on the rear regulating surface 110*f*. The right sensor mechanism 112*a* is a similar mechanism. When the sensor flag 114*a* moves to a position to block the optical axis of the sensor 116*a*, it is detected that the sheet bundle MS abuts on the right regulating portion 110*a* (or a movable regulating surface 117 to be described later).

Figures 23A, 23B, 23C, 23D, 23E:
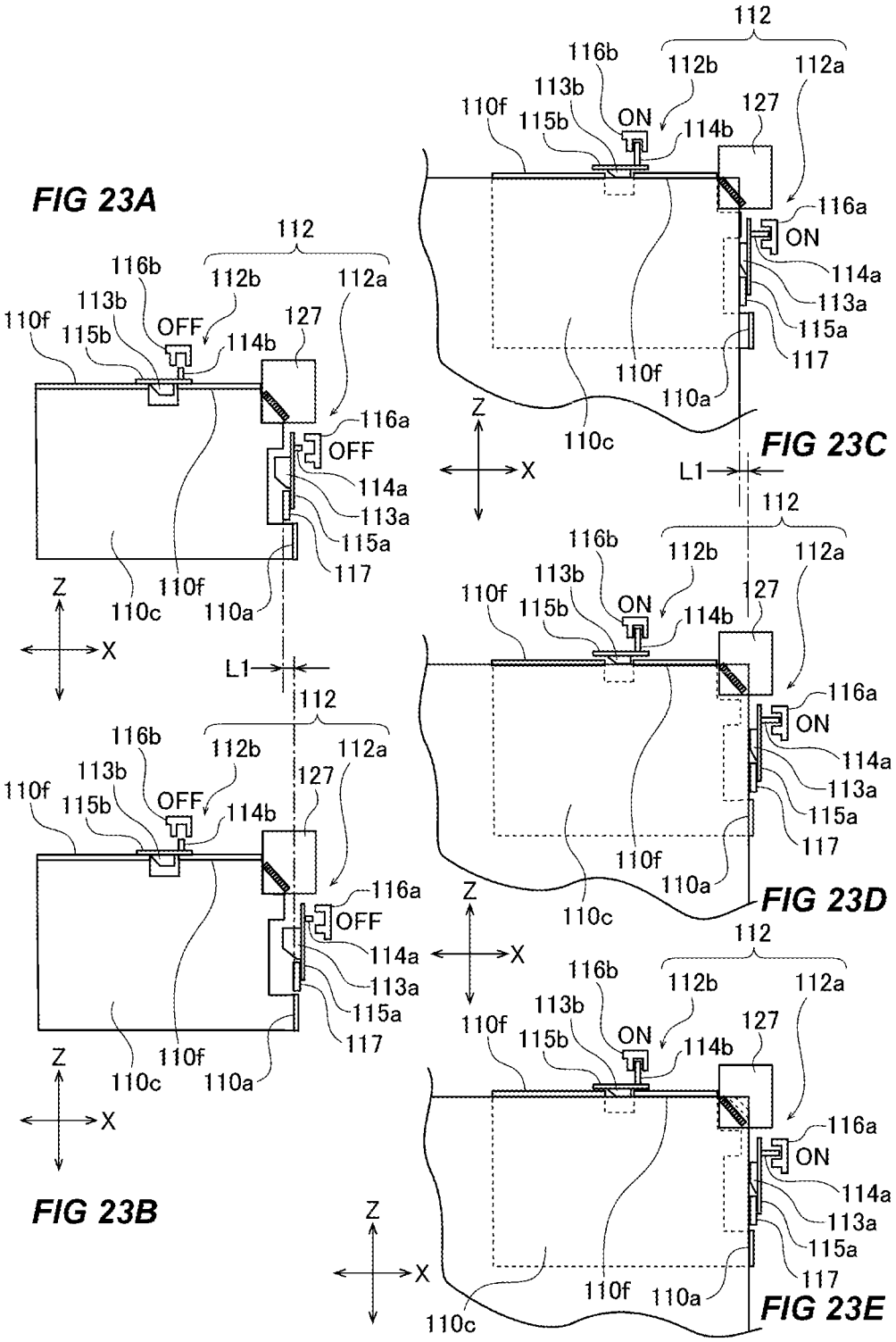
FIGS. 23A to 23E are views illustrating a sheet bundle insertion detection sensor mechanism of a manual insertion port.

The movable regulating surface 117 is movable in the left-right direction of the direction of arrow X, and is movable between a first position illustrated in FIGS. 23A and 23C and a second position illustrated in FIGS. 23B and 23D. When the movable regulating surface 117 moves between the first position and the second position, the position where the pressing portion 127 abuts on the sheet bundle MS can be made different by the distance L1. For example, in a case where it is desired to increase the fastening force of the staple-less binding process, if the staple-less binding process is performed at two different locations, the fastening force can be increased. In addition, in a case where it is desired to loosen the fastening of the sheet bundle MS that has been once subjected to the staple-less binding process, read the sheet bundle by the image reading portion A2 as an original, and subject the sheet bundle to the staple-less binding process again, the fastening force is weak even if the staple-less binding process is performed at exactly the same position. Therefore, in this case, the sheet bundle MS can be fastened again by shifting the position and performing the staple-less binding process (see FIG. 23E).

The movable regulating surface 117 moves between the first position and the second position integrally with the right sensor mechanism 112*a*. Accordingly, it is possible to detect whether the right end of the sheet bundle MS is set at the correct binding position in both the first position and the second position. The movement of the movable regulating surface 117 and the right sensor mechanism 112*a* may be manually moved by the user by providing a lever (not illustrated) on the front cover 121, or may be moved by button operation by separately providing a drive mechanism.

FIGS. 24A to 24E are diagrams for describing an operation in a case where the user moves the sheet bundle MS when the button 111 is pressed by the user and the binding operation is executed after the sheet bundle MS is set at the binding position by the insertion detection sensor mechanism 112 at least once.

Figures 24A, 24B, 24C, 24D, 24E:
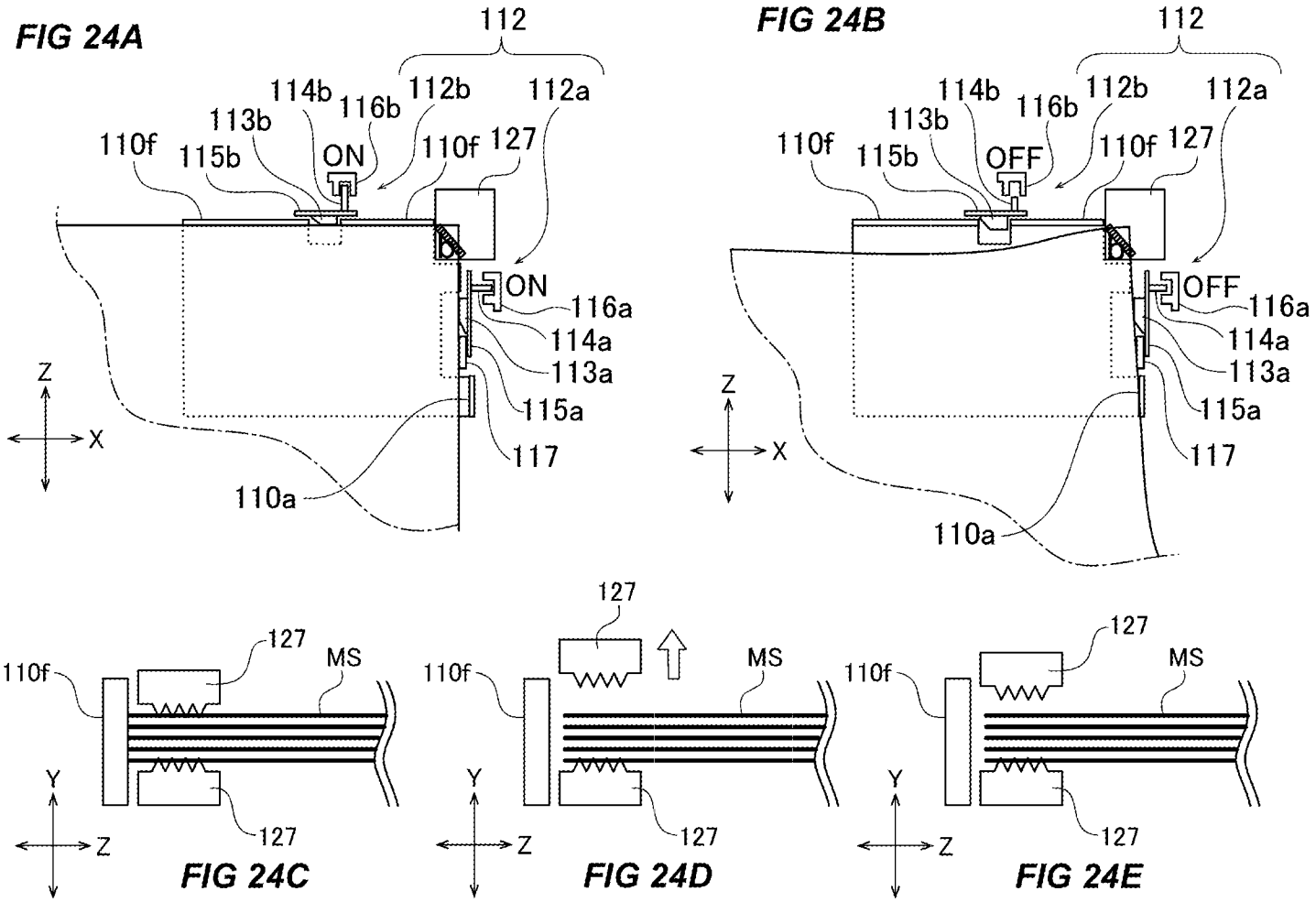
FIGS. 24A to 24E are explanatory diagrams of an operation of a sheet processing apparatus according to the fourth embodiment.

First, when the insertion detection sensor mechanism 112 detects that the sheet bundle MS is set at the binding position and then the button 111 is pressed, the controller drives the motor 128 to move the pressing portion 127 from the separation position toward the binding position. Normally, after the sheet bundle MS is moved to the binding position and bound, the sheet bundle MS is moved again to the separation position and the binding operation is completed. However, if the user moves the sheet bundle MS in a state where the pressing portion 127 moves to the binding position and nips the sheet bundle MS, the sheet bundle MS is pulled in a state where the pressing portion 127 nips the sheet bundle MS as illustrated in FIG. 24B, so that the sheet may tear. Therefore, when the right sensor mechanism 112*a* or the rear sensor mechanism 112*b* is turned off after a predetermined time elapses since the button 111 is pressed, that is, after the pressing portion 127 illustrated in FIG. 24C comes into a state of abutting on the sheet bundle MS (or a state in which the tips of the teeth overlap each other in the vertical direction), the controller reversely drives the motor 128 to move the pressing portion 127 toward the separation position (FIG. 24D).

If any one of the insertion detection sensor mechanisms 112 is turned off before a predetermined time elapses after the button 111 is pressed, the controller stops driving the motor 128 and waits until a predetermined time (for example, 3 seconds) elapses until the insertion detection sensor mechanism 112 is turned on (FIG. 24E). Then, the controller executes the binding process when the insertion detection sensor mechanism 112 is turned on within a predetermined time. When a predetermined time has elapsed, it is determined that the sheet bundle MS has been pulled out, and the pressing portion 127 is returned to the home position, and a binding error message is output.

FIGS. 25A to 25D are enlarged views of the insertion port 110 when the stack-tray-side cover 125 is viewed from the front, and is a view illustrating the support member 118 that supports the lower surface of the sheet bundle MS inserted into the insertion port 110. The support member 118 is configured to be able to advance and retract in the front-rear direction from the first surface 121*a* of the front cover 121, and the user can manually pull out the support member 118 to the support position (FIG. 25A) by hooking a finger in a recess formed in a tip portion (front side) of the support member 118. When not in use, it can be stored at the storage position (FIG. 25C) by being pushed to the rear side.

With the support member 118, it is possible to reduce sagging of a portion deviated from the lower regulating portion 110*c* when a sheet bundle MS having a weak stiffness such as thin paper is inserted, and thus operability of a user at the time of manual binding is good. If the lower regulating portion 110*c* is provided up to the position of the front end in the state where the support member 118 is at the supporting position, the apparatus size becomes large toward the front side. Therefore, the apparatus size can be made compact by adopting a configuration in which the support member 118 can be pulled out only when necessary.

Figure 25A:
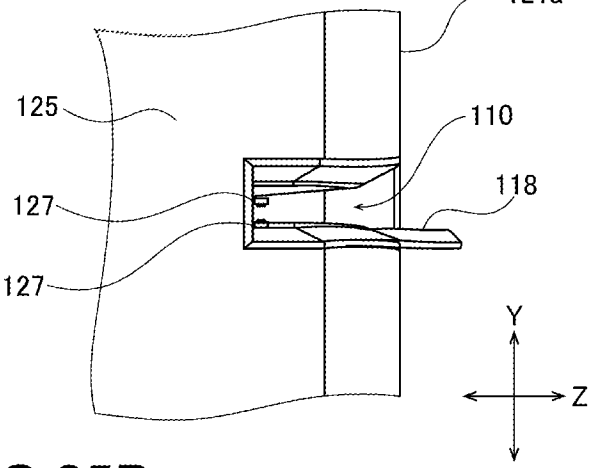
FIGS. 25A to 25D are views illustrating a support member of the manual insertion port.
Figure 25B:
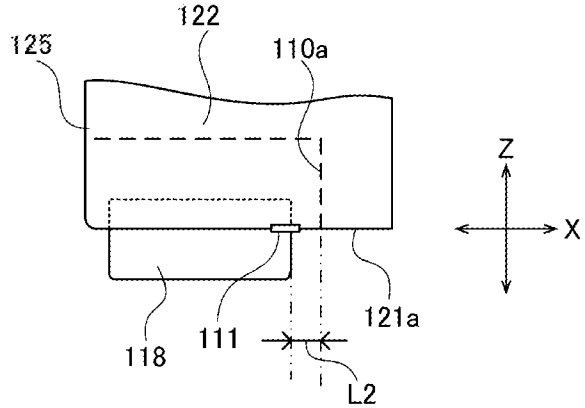
Figure 25C:
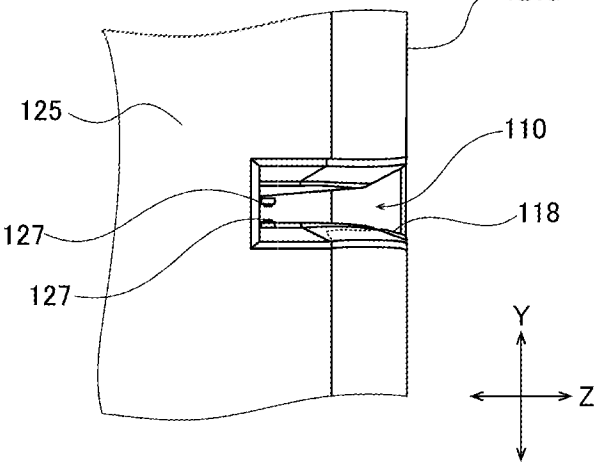
Figure 25D:
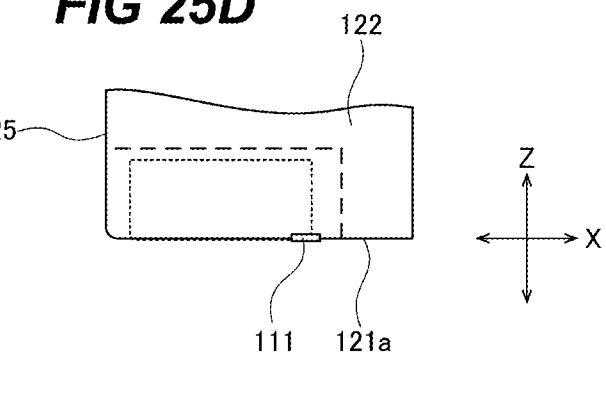

FIG. 25B is a top view of a state in which the support member 118 is at the support position, and FIG. 25D is a top view of a state in which the support member 118 is at the storage position. As can be seen from the drawing, the right end of the support member 118 is disposed on the left side (right side in the direction of arrow X) of the right regulating portion 110*a* of the insertion port 110 by the distance L2. By disposing the support member 118 at this position, when the user inserts the sheet bundle MS into the insertion port 110, the right hand gripping the sheet bundle MS is prevented from hitting the support member 118.

Figure 26A:
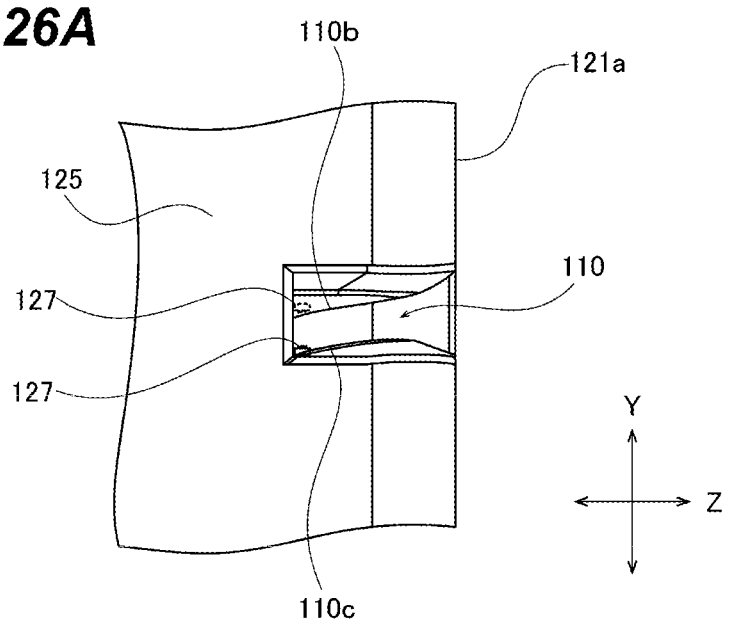
FIGS. 26A and 26B are views illustrating a modification of the manual insertion port.
Figure 26B:
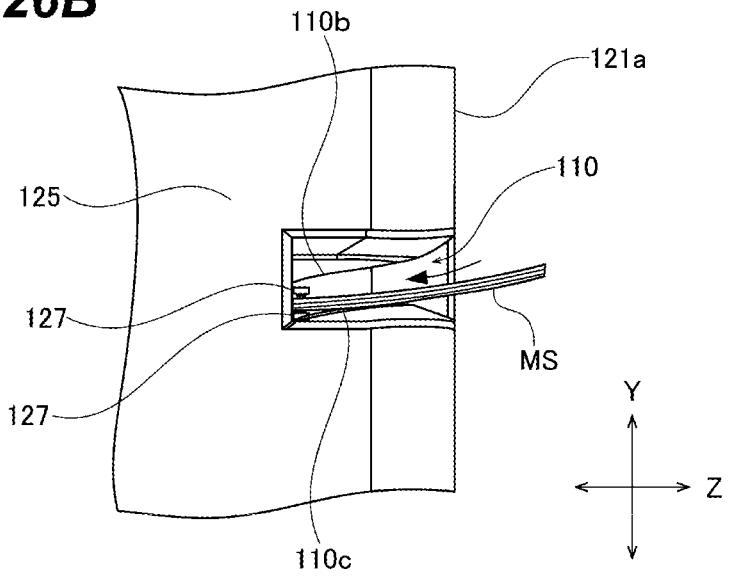

FIGS. 26A and 26B illustrate modification of the insertion port 110. The upper regulating portion 110*b* and the lower regulating portion 110*c* of the insertion port 110 illustrated in FIG. 26A and 26B are configured to be inclined downward from the front side toward the rear side. Therefore, since the sheet bundle MS is inserted in the obliquely downward direction and the user manually supports the sheet bundle MS in this state, it is easy to support the sheet bundle MS as compared with the configuration in which the lower regulating portion 110*c* is horizontal in the front-rear direction.

In this modification, since the rear regulating surface 110*f* (similar to FIG. 23) is disposed substantially vertically, the rear-side end of the obliquely inserted sheet bundle MS abuts on the rear regulating surface 110*f*, and is supported in a state of being slightly curved from the rear-side end toward the front side of the sheet bundle MS. As a result, the stiffness of the sheet bundle MS becomes strong, and the user can easily support the sheet bundle MS. The rear regulating surface 110*f* and the pressing portion 127 may be inclined in accordance with the inclination of the lower regulating portion 110*c*.

Figure 27A:
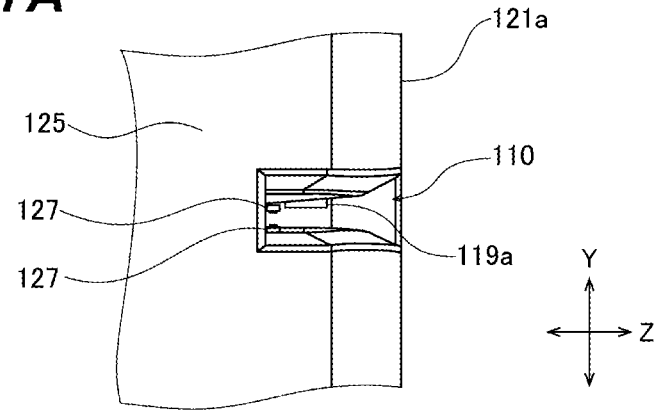
FIGS. 27A to 27C are views illustrating another modification of the manual insertion port.
Figure 27B:
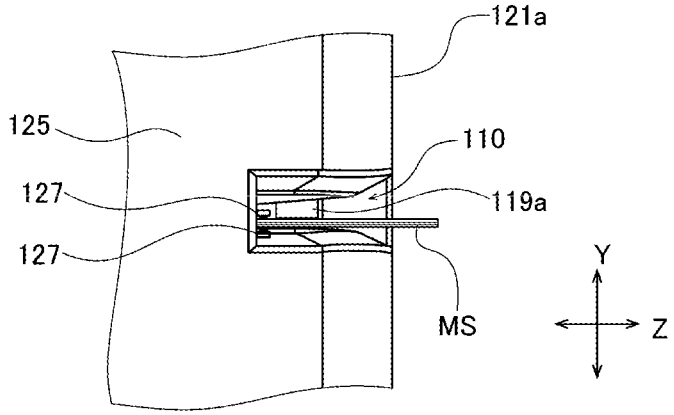
Figure 27C:
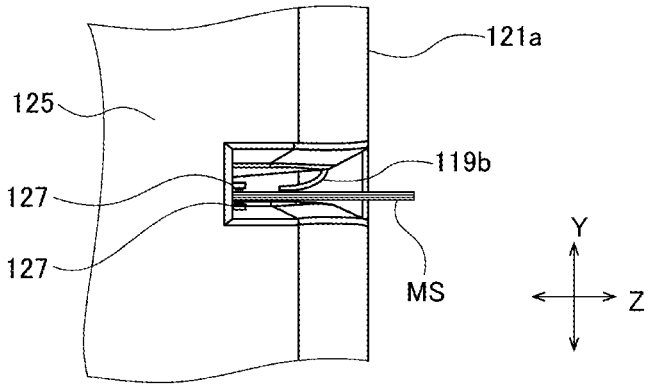

FIGS. 27A to 27C illustrate another modification of the insertion port 110. In FIGS. 27A and 27B, when it is detected that the sheet bundle MS is set at the binding position by the above-described insertion detection sensor mechanism 112, the pressing member 119*a* moves to the pressing position illustrated in FIG. 27B by a driving mechanism (solenoid or the like) (not illustrated), and the sheet bundle MS is nipped between the pressing member 119*a* and the lower regulating portion 110*c*. As a result, the sheet bundle MS set at the binding position is not shifted, and the binding process can be reliably executed.

Further, the pressing member 119*a* is desirably disposed at any position on the right half of the insertion port 110 in the direction of arrow X. As a result, when the sheet bundle MS is pressed by the pressing member 119*a*, the right hand can be released from the sheet bundle MS to press the button 111.

The pressing member 119*b* illustrated in FIG. 27C is a pressing member formed of a flexible material such as Mylar, and extends from the upper regulating portion 110*b* toward the lower regulating portion 110*c* and from the front side toward the rear side. The pressing member 119*b* does not prevent the insertion of the sheet bundle MS, and the position of the inserted sheet bundle MS is stabilized by pressing the upper surface of the inserted sheet bundle MS. The pressing member 119*b* is disposed away from the right regulating portion 110*a* by a predetermined distance so that a corner portion (a portion where the binding process is performed) of the sheet bundle MS does not hit the pressing member when the sheet bundle MS subjected to the binding process is pulled out from the insertion port 110. Note that the tip of the pressing member 119*b* is disposed slightly upward so as to be separated from the lower regulating portion 110*c*, whereby the corner of the sheet bundle MS is not caught by the pressing member 119*b* even if the corner of the sheet bundle MS subjected to the binding process passes.

Figure 28:
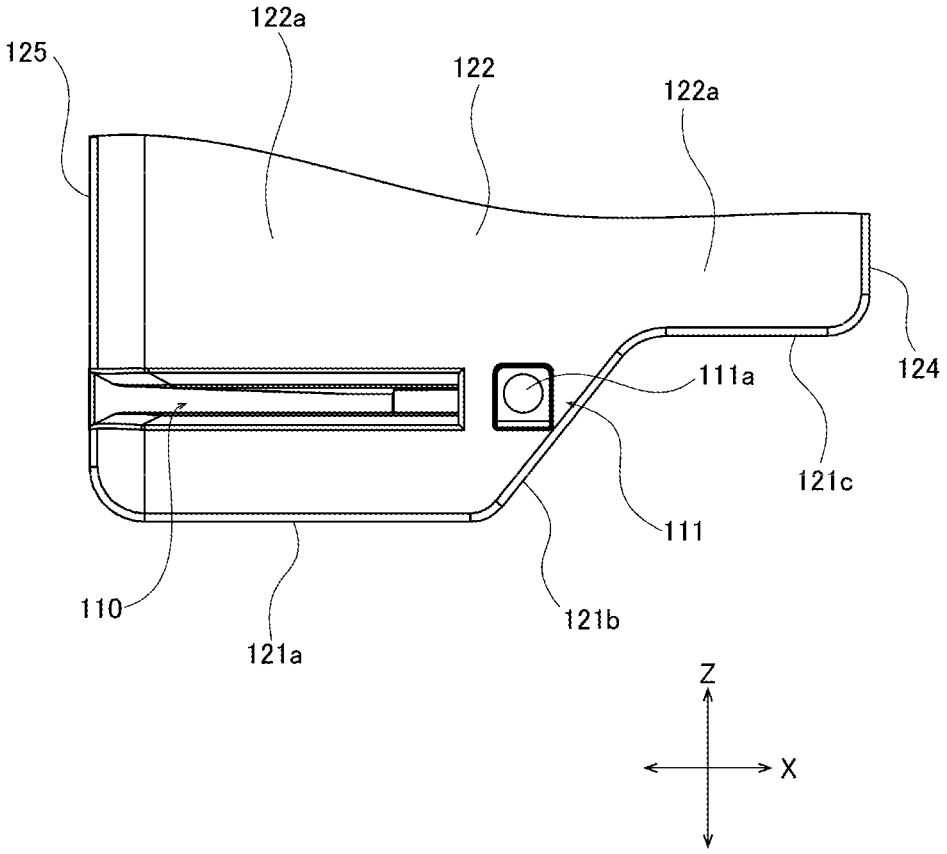
FIG. 28 is a top view illustrating a modification in which a manual insertion port is provided in a top cover.
Figure 29A:
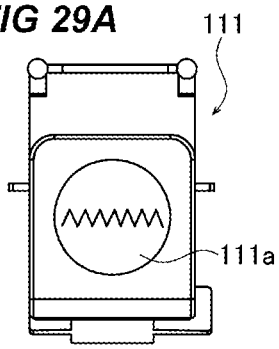
FIGS. 29A to 29L are views illustrating a design of a pressing portion of a button for executing a manual binding process.
Figure 29B:
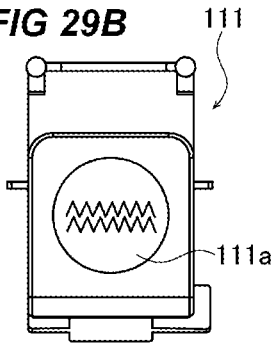
Figure 29C:
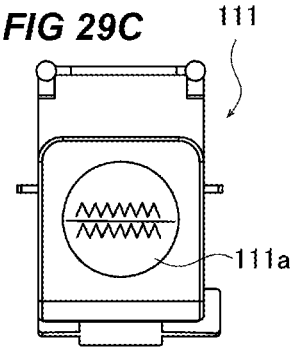
Figure 29D:
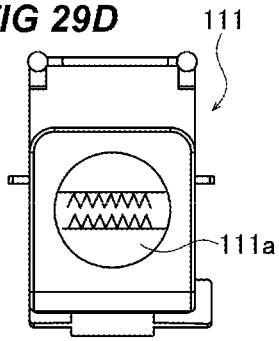
Figure 29E:
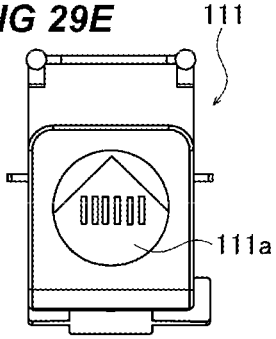
Figure 29F:
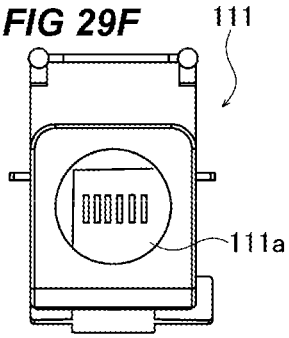
Figure 29G:
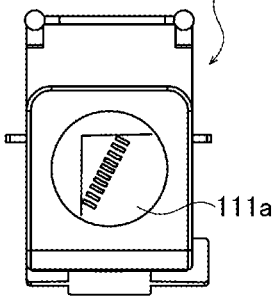
Figure 29H:
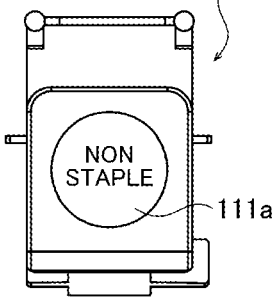
Figure 29I:
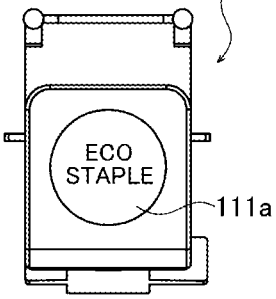
Figure 29J:
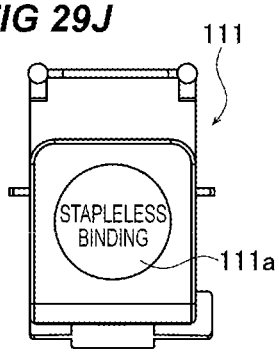
Figure 29K:
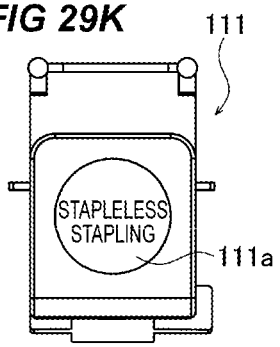
Figure 29L:
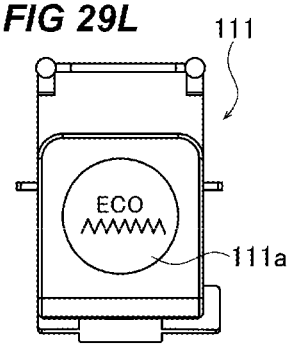

In the embodiment described above, the aspect in which the insertion port 110 and the button 111 are arranged on the front cover 121 (10*a*) has been described, but the insertion port 110 and the button 111 may be arranged on the top cover 122 as illustrated in FIG. 28. In this case, when the insertion port 110 is disposed on the front side of the horizontal surface 122*a* of the top cover 122, the sheet bundle MS can be inserted into the insertion port 110 without substantially changing the posture of the sheet bundle MS aligned on the horizontal surface 122*a*.

When the insertion port 110 is formed in the top cover 122, it is desirable to arrange the insertion port 110 so that the sheet bundle MS can be inserted in a state where the sheet surface of the sheet bundle MS faces the front side as illustrated in FIG. 28. Further, the lower regulating surface that regulates the downstream end in the insertion direction of the sheet bundle MS is desirably inclined downward from the left side to the right side. In this case, when the right regulating surface is also formed in the direction orthogonal to the lower regulating surface in accordance with the inclination of the lower regulating surface, the corner of the sheet bundle MS is easily positioned at the binding position.

Although the staple-less binding unit 27 of the first embodiment is connected to the substrate provided on the rear sheet metal 30*r* and the entire sheet post-processing apparatus B is controlled on the substrate, the controller of the control substrate 1300 provided on the bracket 126 may control the manual binding so that only the power is supplied from the substrate provided on the rear sheet metal 30*r*. In this case, the staple-less binding unit 27 that performs manual binding is a so-called stand-alone-type sheet binding apparatus that does not exchange information with both the image forming apparatus A and the automatic binding unit B1. That is, the motor 128 of the staple-less binding unit 27, the sensor of the drive transmission portion 129, the button 111, and the insertion detection sensor mechanism 112 are connected to the control substrate 1300. When the insertion detection sensor mechanism 112 detects that a sheet has been inserted and further detects that the button 111 has been pressed, the motor 128 is driven to perform the staple-less binding process on the sheet bundle set in the insertion port 110. In addition, in the case of the stand-alone type, even if the opening/closing cover 101 is open or a jam occurs in the image forming apparatus A and the jam release cover of the image forming apparatus A is open, the staple-less binding unit 27 can execute the binding operation unless the power is turned off.

Here, a light emitting member that emits light of a plurality of colors may be provided on the button 111 and connected to the control substrate 1300, and the state of the manual binding unit B2 may be notified to the user by the light emitted by the button.

For example, when the insertion detection sensor mechanism 112 detects that the sheet has been set, the controller causes the light emitting member to emit light in green to notify the user that the staple-less binding unit is in the standby state (binding process can be executed). Thereafter, when the button 111 is pressed by the user, for example, flashing light is emitted until the binding process is completed to call the user's attention not to pull out the sheet during the binding process. Then, when the binding process is finished, the light emitting member is turned off, or the light emitting member is caused to emit strong light once or another color is caused to emit light and then turned off to notify the user that the binding process is finished. In addition, light may be emitted until it is detected that the binding process is finished and the insertion detection sensor mechanism is turned off (the sheet is pulled out).

In addition, when the sensor of the drive transmission portion 129 detects that the pressing portion 127 does not move even if the button 111 is pressed to drive the motor 128, the controller determines as an error and causes the light emitting member to emit red light to notify the user of the error. The light emitting member may be disposed on the first surface 121*a* side of the front cover 121 with respect to the control substrate 1300, and a portion of the first surface 121*a* facing the portion where the light emitting member is disposed may be formed of a light-transmissive material so that the light emitting state of the light emitting member can be confirmed through the front cover 121.

Figure 30A:
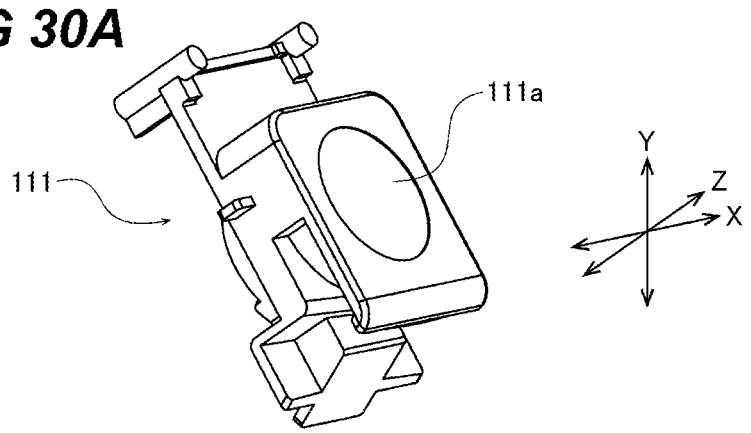
FIGS. 30A to 30C are perspective views of buttons for executing a manual binding process.
Figure 30B:
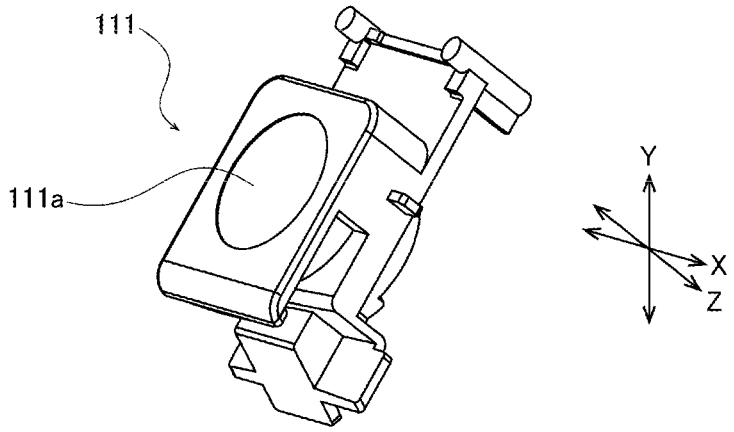
Figure 30C:
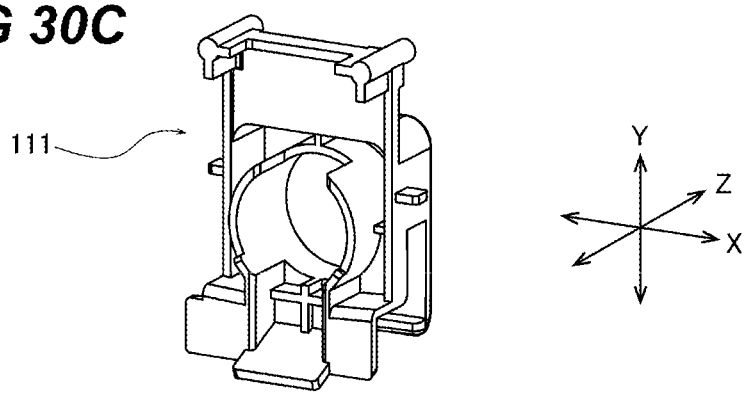

FIGS. 29A to 29L illustrate design examples applied to the pressing portion 111*a* of the button 111. FIGS. 30A to 30C are perspective views of the button 111 as viewed from three directions.

In the second embodiment, the aspect in which the retraction surface 135 is formed below the first surface 121*a* of the front cover 121 has been described. However, the retraction surface 135 may not be formed by extending the first surface 121*a* downward.

In the embodiment described above, the staple cartridge 170 is replaced by opening the opening/closing cover 101 provided in the front covers 10*a* and 121, but the present invention is not limited to this configuration. For example, the opening/closing cover 101 may not be provided, and the staple cartridge 170 may be configured to be replaceable by opening the front cover 10*a* or 121 constituting the exterior of the sheet processing apparatus B. In this case, the shielding member 103 may be fixed to the front sheet metal 30*f* instead of being provided integrally with the front cover 10*a* or 121.

According to the present invention, it is possible to perform manual binding by the staple-less binding unit on the front side of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-207678, filed Dec. 23, 2022, No. 2022-207938, filed Dec. 26, 2022, No. 2023-015730, filed Feb. 3, 2023, No. 2023-190678, filed Nov. 8, 2023, which are hereby incorporated by reference herein in their entirety.

What is claimed is:

1. A sheet processing apparatus that performs a binding process on a sheet, the sheet processing apparatus comprising:

a stacking portion configured to stack the sheet;

a first binding unit including a cartridge loaded with staples is detachably attached, the first binding unit being configured to perform a binding process on a plurality of sheets stacked on the stacking portion, the first binding unit being movable between a binding position at which the binding process is performed on the sheets and a replacement position at which the cartridge is replaced, the replacement position being positioned on a front side with respect to the binding position in a front-rear direction of the sheet processing apparatus;

a second binding unit configured to bind a plurality of sheets inserted via an insertion port arranged to receive a plurality of sheets from outside of the sheet processing apparatus, the second binding unit configured to bind the sheets without using a staple;

a first cover that constitutes a portion of an exterior of the sheet processing apparatus on a front side with respect to the stacking portion in the front-rear direction and is configured to partially cover the second binding unit, the first cover including the insertion port and an opening portion configured to allow access to the first binding unit positioned at the replacement position; and a second cover that is openable and closable with respect to the first cover portion and configured to cover the opening portion, wherein the second binding unit is provided at a position overlapping the first binding unit positioned at the replacement position in the front-rear direction.

2. The sheet processing apparatus according to claim 1, wherein the first cover includes a passing portion through which the cartridge passes when the cartridge is inserted and removed from the first binding unit, and in a state where the first binding unit is positioned at the replacement position, a portion of the binding unit overlaps the passing portion in the front-rear direction of the sheet processing apparatus.

3. The sheet processing apparatus according to claim 1, further comprising:

an operation button configured to operate by a user for instruct execution of a binding process by the second binding unit, wherein the operation button is provided above the insertion port in a vertical direction.

4. The sheet processing apparatus according to claim 1, further comprising:

a controller that executes the binding process by the second binding unit after the binding process by the first binding unit is completed in a case where the binding process by the second binding unit is to be executed and the binding process by the first binding unit is being executed.

5. The sheet processing apparatus according to claim 4, wherein in a case where execution related to the binding process by the second binding unit is received and the binding process by the first binding unit is executed within a predetermined time, the controller preferentially executes the binding process by the first binding unit, and executes the binding process by the second binding unit after the binding process by the first binding unit is completed.

6. The sheet processing apparatus according to claim 1, further comprising:

a pressing portion provided in the insertion port to press the sheet bundle inserted through the insertion port.

7. An image forming system comprising:

an image forming apparatus having an image forming portion forming an image on a sheet;

the sheet processing apparatus according to claim 1 performing a binding process on a sheet on which an image is formed by the image forming apparatus; and a housing apparatus that is provided at a position overlapping the sheet processing apparatus in a vertical direction and below the sheet processing apparatus, and accommodates a sheet to be supplied to the image forming apparatus.

8. The image forming system according to claim 7, wherein the image forming apparatus further includes a stacking tray which is provided between the sheet processing apparatus and the housing apparatus in the vertical direction and on which a sheet to be conveyed to the image forming portion is stacked.

9. The sheet processing apparatus according to claim 1, wherein the second binding unit is configured to bind a plurality of sheets inserted from the insertion port by applying pressure on the plurality of sheets.

* * * * *